US006303261B1

(12) United States Patent
Arakawa et al.

(10) Patent No.: US 6,303,261 B1
(45) Date of Patent: Oct. 16, 2001

(54) SILVER HALIDE COLOR PHOTOGRAPHIC MATERIAL AND IMAGE FORMING METHOD USING THE SAME

(75) Inventors: Jun Arakawa; Toshio Kawagishi, both of Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/525,946

(22) Filed: Mar. 15, 2000

(30) Foreign Application Priority Data

Mar. 19, 1999 (JP) ..... 11-068520

(51) Int. Cl.[7] ..... G03C 7/305

(52) U.S. Cl. ..... 430/203; 430/214; 430/218; 430/351; 430/380; 430/554; 430/558; 430/559; 430/957; 430/958; 430/959

(58) Field of Search ..... 430/203, 214, 430/218, 351, 380, 957, 958, 959, 559, 554, 558

(56) References Cited

U.S. PATENT DOCUMENTS

| | | | | |
|---|---|---|---|---|
| 2,998,314 | * | 8/1961 | Puschel . | |
| 3,876,428 | * | 4/1975 | Murin et al. . | |
| 5,139,919 | | 8/1992 | Taguchi et al. . | |
| 5,262,274 | * | 11/1993 | Katch | 430/264 |
| 5,447,833 | * | 9/1995 | Motoki et al. | 430/544 |
| 5,998,105 | * | 12/1999 | Murakoski | 430/375 |

FOREIGN PATENT DOCUMENTS 19629142 1/1998 (DE) .

* cited by examiner

*Primary Examiner*—Thorl Chea
(74) *Attorney, Agent, or Firm*—Birch, Stewart, Kolasch & Birch, LLP

(57) ABSTRACT

Disclosed are a silver halide color photographic material having on a support a photographic element in which silver halide grains, a developing agent and a coupler capable of forming a dye by reaction with an oxidation product of the developing agent are incorporated, the photographic element further comprising at least one color stain inhibitive compound represented by the following formula (SC-1) or (SC-2) and at least one photographically useful group-releasing compound represented by the following formula (II); and a method of forming color images by the use of the foregoing material:

(SC-1)

(SC-2)

$$A—[(L_1)_a—(B)_m]_p—(L_2)_n—PUG \quad (II)$$

10 Claims, 1 Drawing Sheet

SILVER HALIDE COLOR PHOTOGRAPHIC MATERIAL AND IMAGE FORMING METHOD USING THE SAME

FIELD OF THE INVENTION

The present invention relates to a silver halide color photographic material suitable for simple and rapid processing. More specifically, the invention relates to a simply and rapidly processable silver halide color photographic material that can form color images of high quality, especially high color saturation, as it keeps a high photographic speed (sensitivity).

BACKGROUND OF THE INVENTION

In recent years, silver halide-utilized photographic light-sensitive materials have attained increasing development in their photographic properties. As a result, color images of high quality can be obtained with ease at present. In the system usually referred to as color photography, for instance, photographs are made with color negative films, and the image information recorded on each of the developed color negative films is optically printed on color photographic paper, thereby providing color prints. The latest high degree of development in this process and the spread of not only the so-called color lab as a large-scale local base, wherein color prints are mass-produced at high efficiency, but also the so-called mini-lab, or small-sized simplified print processors installed in stores, have enabled everybody to easily amuse oneself with color photographs.

As the principle of color photography which prevails at the present, the optical print system using color reproduction based on subtractive color process is usually adopted. A general color negative has on a transparent support at least three kinds of light-sensitive layers using silver halide emulsions as light-sensitive elements on which are conferred sensitivities in the blue, green and red regions respectively. And the so-called color couplers forming yellow, magenta and cyan dyes respectively are incorporated into the foregoing light-sensitive layers so that the hue of the dye formed from each color coupler bears the complementary color relation to the color sensitivity of the light-sensitive layer into which the color coupler is incorporated. The color negative films exposed imagewise by photography are developed in a color developer containing an aromatic primary amine developing agent. Therein, the exposed silver halide grains are developed, or reduced, by the developing agent, and at the same time the developing agent is oxidized. The thus oxidized developing agent undergoes the coupling reaction with the color couplers as mentioned above to form dyes. Further, the metallic silver produced by development (developed silver) and silver halide remaining unreacted are removed by bleach processing and fixation processing respectively. Thus, dye images are obtained. The color photographic paper, namely a color photosensitive material comprising a reflective support coated with light-sensitive layers wherein the sensitive wavelength region and the hue of the developed color are combined in the same manner as described above, is subjected to optical exposure via a photographically processed color negative film. Further, the thus exposed color photographic paper is subjected to successive color development, bleach and fixation in the same manners as the above, thereby providing the color print made up of dye images reproducing the original scene.

Besides such a classic image formation method, the formation of prints by converting the image information recorded in color negative to digital information by means of a scanner and then subjecting the digital information to diverse image processing to improve the image quality has become possible lately. Actually, the mini-lab systems loaded with such image processing devices are in operation, too.

Under these circumstances, the demand for enhancing the simplicity and easiness of the method for forming images in color negative is growing. The actual situation in the image formation in color negative has the following three problems: Firstly, the processing baths for color development, bleach and fixation require accurate control of their compositions and temperatures, so that special knowledge and skilled operation are necessitated. Secondly, the processing baths contains ingredients the discharge of which is regulated from the view point of environmental protection, such as color developing agents and chelate compounds having iron ion at the center, which are used as bleaching agent, so that there are not a few cases where facilities for environmental protection are required for the installation of developing apparatus and so on. Thirdly, the processing time, though it has been shortened by the recent technical developments, is not yet short enough to meet the current requirement for rapid reproduction of recorded images.

In such contexts, there is a growing demand for construction of a color image formation system that uses neither color developing solution no bleaching solution, which are used in the existing color image formation system, and thereby enables reduction in a load of environmental pollution and improvement in simplicity and easiness of color image formation. In addition, continued improvement toward limitless simplification of the image formation method using processing solutions is also indispensable in competing against the system using an electronic still camera.

In view of the situation mentioned above, many improved arts have been proposed. For instance, the system disclosed in *IS & T's 48th Annual Conference Proceedings,* page 180, makes a bleach-fix bath, which is essential to the conventional color photographic processing, unnecessary by transferring the dyes produced by development reaction into a mordant layer and then peeling apart the mordant layer to effect the removal of developed silver and silver halide remaining unreacted. However, the art proposed therein still requires the development using a processing bath containing a color developing agent, and so it is hard to say that the environmental protection problem is solved thereby.

As to the system that makes the processing solution containing a color developing agent unnecessary, the Pictrography system is provided by Fuji Photo Film Co., Ltd. In this system, a small amount of water is supplied to a photographic element containing a base precursor, the resulting photographic element is brought into face-to-face contact with an image-receiving element, and then heat is applied thereto to cause the development reaction. Since such a system has the environmental advantage of using no processing baths, the thought which occurs first is to utilize it for the image formation in photosensitive materials for taking photographs.

As an example thereof, the method of incorporating a developing agent and couplers in a photosensitive material to form developed color images therein is disclosed in JP-A-9-10506 (the term "JP-A" as used herein means an "unexamined published Japanese patent application) and European Patent 0,762,201.

The Pictrography system makes the use of a developing solution unnecessary, and therein the mere supply of a small amount of water can trigger off the development. In other words, the base generation necessary for the progress of heat development is effected by the foregoing simple method. Further, the system of the foregoing type, or the system of incorporating a developing agent together with couplers in a photosensitive material and promoting the development by heating, is known to have an advantage of enabling a sharp reduction in development-processing time, specifically a reduction to from ⅕ to 1/20 of conventional ones.

It has so far been said that the method of causing the coupling reaction by generation of a base from the developing agent incorporated in a photosensitive material, supply of a base from the outside, or/and heating is effective in realizing the simple and rapid processing which is the trend of the times. And various attempts have been made.

Although the developing method comprising the incorporation of a developing agent in a photosensitive material and a heating operation is useful in particular, it has a big problem of tending to cause fog generation. In the case of such a developing method, it has further been revealed that the nondiffusible hydroquinones generally used as color stain inhibitor in conventional silver halide color photographic materials were practically ineffective for inhibiting the generation of color stains at the time of processing, but on the contrary they greatly aggravated the processing fog. Furthermore, the incorporation of both developing agent and photographically useful group (PUG) releasing coupler in a photosensitive material has been shown to have a great problem of causing the generation of serious fog and the lowering of sensitivity.

Thus, the development of techniques for preventing color stains from generating at the time of processing while desirably controlling the image structure by the use of PUG releasing compounds has become an urgent task.

SUMMARY OF THE INVENTION

Objects of the invention are to provide a silver halide color photographic material which can form color images of high color saturation without attended by an increase of fog and a decrease of sensitivity when it undergoes simple and rapid processing, particularly the processing following a heat development method, and further to provide a method for forming images using such a material.

The aforementioned objects are attained with the following embodiments (1) to (5):

(1) A silver halide color photographic material having on a support a photographic element in which silver halide grains, a developing agent and a coupler capable of forming a dye by reaction with an oxidation product of the developing agent are incorporated, with the photographic element further comprising at least one compound represented by the following formula (SC-1) or (SC-2) and at least one compound represented by the following formula (II):

(SC-1)

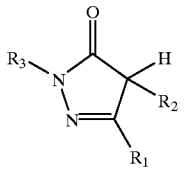

-continued (SC-2)

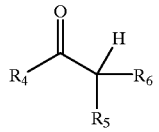

wherein $R_1$ represents a hydrogen atom or a substituent group, $R_2$ represents an alkyl group, an alkenyl group, an alkynyl group, an aryl group, a heterocyclic group, an alkoxycarbonyl group, an aryloxycarbonyl group or a carbamoyl group, $R_3$ represents a hydrogen atom, an alkyl group, an alkenyl group, an alkynyl group, an aryl group or a heterocyclic group, $R_4$ represents an alkyl group, an alkenyl group, an alkynyl group, an aryl group, a heterocyclic group, an alkoxy group, an aryloxy group, a heterocyclyloxy group, an amino group or an anilino group, $R_5$ represents an alkoxycarbonyl group, an aryloxycarbonyl group or a carbamoyl group, and $R_6$ represents an alkyl group, an alkenyl group, an alkynyl group, an aryl group or a heterocyclic group, or a group forming a 5- to 7-membered ring by combining with R4;

$$A—[(L_1)_a—(B)_m]_p—(L_2)_n—PUG \quad (II)$$

wherein A represents a group splitting off the moiety $[(L_1)_a—(B)_m]_p—(L_2)_n—PUG$ by reacting with the oxidation product of the developing agent, $L_1$ is a linkage group whose bond on the right side ($L_1$—B bond) is cleaved after cleavage of the bond on the left side, B represents a group causing the cleavage of the bond on the right side by the reaction with the oxidation product of the developing agent, $L_2$ represents a linkage group whose bond on the right side ($L_2$—PUG bond) is cleaved after cleavage of the bond on the left side, PUG represents a photographically useful group, a, m and n are each 0 or 1, and p is an integer of 0 to 2, wherein two $[(L_1)_a—(B)_m]$ moieties in the case of p=2 are the same or different.

(2) A silver halide color photographic material according to Embodiment (1), wherein the PUG in formula (II) is a development inhibitor.

(3) A silver halide color photographic material according to Embodiment (1) or (2), wherein the photographic element comprises at least three silver halide light-sensitive layers differing in spectral sensitivity and at least one compound represented by formula (SC-1) or (SC-2) is contained in a light-insensitive layer disposed between two adjacent light-sensitive layers differing in spectral sensitivity.

(4) A silver halide color photographic material according to Embodiment (1), (2) or (3), wherein the photographic element has a silver halide emulsion layer wherein at least 50% of the total silver halide grains are tabular grains having an aspect ratio of from 8 to 50.

(5) A method of forming color images, comprising the steps of (i) preparing a silver halide color photographic material according to any of Embodiments (1) to (4) and a processing element comprising a support and a processing layer which is coated thereon and contains at least a base and/or a base precursor, (ii) subjecting the color photographic material to imagewise exposure, (iii) applying water to the photographic material and/or the processing element in an amount corresponding to from 1/10 to 10/10 of the amount required for causing the maximum swelling in both the photographic element of the photographic material and the processing element, except in the backing layers of the photographic material and the processing element, and (iv) bringing the surface of the light-sensitive material on the photographic element side into a face-to-face contact with the processing layer of the processing element and heating them at a temperature of 50° to 100° C. for a period of 5 to 60 seconds to form color images.

DETAILED DESCRIPTION OF THE INVENTION

Figure 1:
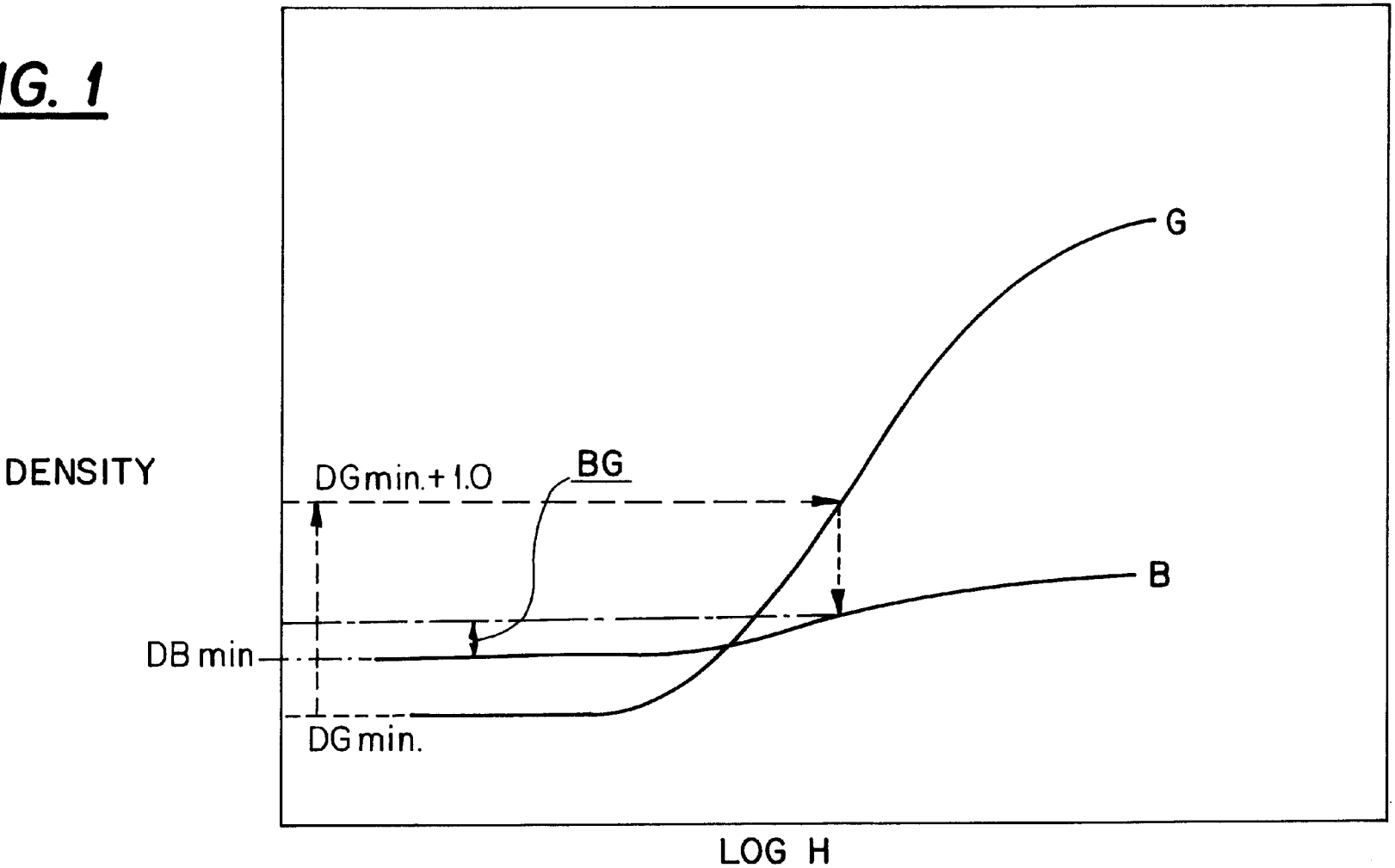
FIG. 1 is a characteristic curve (H-D curve) showing how to determine Bg. Gr also can be determined in the same way as Bg.

The compounds represented by formula (SC-1) are illustrated below in detail.

$R_1$ represents a hydrogen atom or a substituent group. More specifically, $R_1$ represents a hydrogen atom, a halogen atom (e.g., fluorine, chlorine, bromine), an alkyl group (preferably a straight-chain, branched or cyclic alkyl group containing 1 to 32 carbon atoms, e.g., methyl, ethyl, propyl, isopropyl, butyl, t-butyl, 1-octyl, tridecyl, cyclopropyl, cyclopentyl, cyclohexyl, 1-norbornyl, 1-adamantyl), an alkenyl group (preferably an alkenyl group containing 2 to 32 carbon atoms, e.g., vinyl, allyl, 3-butene-1-yl), an alkynyl group (preferably an alkynyl group containing 2 to 32 carbon atoms, e.g., ethynyl, 1-propylnyl), an aryl group (preferably an aryl group containing 6 to 32 carbon atoms, e.g., phenyl, 1-naphthyl, 2-naphthyl), a heterocyclic group (preferably a 5- to 8-membered heterocyclic group containing 1 to 32 carbon atoms, e.g., 2-thienyl, 4-pyridyl, 2-furyl, 2-pyrimidyl, 1-pyridyl, 2-benzothiazolyl, 1-imidazolyl, 1-pyrazolyl, benzotriazole-2-yl), a silyl group (preferably a silyl group containing 3 to 32 carbon atoms, e.g., trimethylsilyl, triethylsilyl, tributylsilyl, t-butyldimethylsilyl, t-hexyldimethylsilyl), a hydroxyl group, an alkoxy group (preferably an alkoxy group containing 1 to 32 carbon atoms, e.g., methoxy, ethoxy, 1-butoxy, 2-butoxy, isopropoxy, t-butoxy, dodecyloxy, cyclopentyloxy, cyclohexyloxy), an aryloxy group (preferably an aryloxy group containing 6 to 32 carbon atoms, e.g., phenoxy, 2-naphthoxy), a heterocyclyloxy group (preferably a heterocyclyloxy group containing 1 to 32 carbon atoms, e.g., 1-phenyltetrazole-5-oxy, 2-tetrahydropranyloxy, 2-furyloxy), a silyloxy group (preferably a silyloxy group containing 1 to 32 carbon atoms, e.g., trinethylsilyloxy, t-butyldimethylsilyloxy, diphenylmethylsilyloxy), an acyloxy group (preferably an acyloxy group containing 2 to 32 carbon atoms, e.g., acetoxy, pivaroyloxy, benzoyloxy, dodecanoyloxy), an alkoxycarbonyloxy group (preferably an alkoxycarbonyloxy group containing 2 to 32 carbon atoms, e.g., ethoxycarbonyloxy, t-butoxycarbonyloxy, cyclohexyloxycarbonyloxy), an aryloxycarbonyloxy group (preferably an aryloxycarbonyloxy group containing 7 to 32 carbon atoms, e.g., phenoxycarbonyloxy), a carbamoyloxy group (preferably a carbamoyloxy group containing 1 to 32 carbon atoms, e.g., N,N-dimethylcarbamoyloxy, N-butylcarbamoyloxy), a sulfamoyloxy group (preferably a sulfamoyloxy group containing 1 to 32 carbon atoms, e.g., N,N-diethylsulfamoyloxy, N-propylsulfamoyloxy), an alkanesulfonyloxy group (preferably an alkanesulfonyloxy group containing 1 to 32 carbon atoms, e.g., methanesulfonyloxy, hexadecanesulfonyloxy), an arenesulfonyloxy group (preferably an arenesulfonyloxy group containing 6 to 32 carbon atoms, e.g., benzenesulfonyloxy), a cyano group, an acyl group (preferably an acyl group containing 1 to 32 carbon atoms, e.g., formyl, acetyl, pivaloyl, benzoyl, tetradecanoyl), an alkoxycarbonyl group (preferably an alkoxycarbonyl group containing 2 to 32 carbon atoms, e.g., methoxycarbonyl, ethoxycarbonyl, octadecyloxycarbonyl, cyclohexyloxycarbonyl), an aryloxycarbonyl group (preferably an aryloxycarbonyl group containing 7 to 32 carbon atoms, e.g., phenoxycarbonyl), a carbamoyl group (preferably a carbamoyl group containing 1 to 32 carbon atoms, e.g., carbamoyl, N,N-dibutylcarbamoyl, N-ethyl-N-octylcarbamoyl, N-propylcarbamoyl), an amino group (preferably an amino group containing up to 32 carbon atoms, e.g., amino, methylamino, N,N-dioctylamino, tetradecylamino, octadecylamino), an anilino group (preferably an anilino group containing 6 to 32 carbon atoms, e.g., anilino, N-methylanilino), a heterocyclylamino group (preferably a carbonamido group containing 1 to 32 carbon atoms, e.g., 4-pyridylamino), a carbonamido group (preferably a carbonamido group containing 2 to 32 carbon atoms, e.g., acetamido, benzamido, tetradecanamido), an uredio group (preferably an ureido group containing 1 to 32 carbon atoms, e.g., ureido, N,N-dimethylureido, N-phenylureido), an imido group (preferably an imido group containing up to 10 carbon atoms, e.g., N-succinimido, N-phthalimido), an alkoxycarbonylamino group (preferably an alkoxycarbonylamino group containing 2 to 32 carbon atoms, e.g., methoxycarbonylamino, ethoxycarbonylamino, t-butoxycarbonylamino, octadecyloxycarbonylamino, cycloalkyloxycarbonylamino), an aryloxycarbonylamino group (preferably an aryloxycarbonylamino group containing 7 to 32 carbon atoms, e.g., phenoxycarbonylamino), a sulfonamido group (preferably a sulfonamido group containing 1 to 32 carbon atoms, e.g., methanesulfonamido, butanesulfonamido, benzenesulfonamido, hexadecanesulfonamido), a sulfamoylamino group (preferably a sulfamoylamino group containing 1 to 32 carbon atoms, e.g., N,N-dipropylsulfamoylamino, N-ethyl-N-dodecylsulfamoylamino), an azo group (preferably an azo group containing 1 to 32 carbon atoms, e.g., phenylazo), a nitro group, an alkylthio group (preferably an alkylthio group containing 1 to 32 carbon atoms, e.g., ethylthio, octylthio, cycloalkylthio), an arylthio group (preferably an arylthio group containing 6 to 32 carbon atoms, e.g., phenylthio), a heterocyclylthio group (preferably a heterocyclylthio group containing 1 to 32 carbon atoms, e.g., 2-benzothiazolylthio, 2-pyridylthio, 1-phenyltetrazolylthio), an alkanesulfinyl group (preferably an alkanesulfinyl group containing 1 to 32 carbon atoms, e.g., dodecanesulfinyl), an arenesulfinyl group (preferably an arenesulfinyl group containing 6 to 32 carbon atoms, e.g., benzenesulfinyl), an alkanesulfonyl group (preferably an alkanesulfonyl group containing 1 to 32 carbon atoms, e.g., methanesulfonyl, octanesulfonyl), an arenesulfonyl group (preferably an arenesulfonyl group containing 6 to 32 carbon atoms, e.g., benzenesulfonyl, 1-naphthalenesulfonyl), a sulfamoyl group (preferably an sulfamoyl group containing up to 32 carbon atoms, e.g., sulfamoyl, N,N-dipropylsulfamoyl, N-ethyl-N-dodecylsulfamoyl), a sulfo group, a phosphonyl group (preferably a phosphonyl group containing 1 to 32 carbon atoms, e.g., phenoxyphosphonyl, octyloxyphosphonyl, phenylphosphonyl), or a phosphinoylamino group (preferably a phosphinoylamino group containing 2 to 32 carbon atoms, e.g., diethoxyphosphinoylamino, dioctyloxyphosphinoylamino).

$R_2$ represents an alkyl group, an alkenyl group, an alkynyl group, an aryl group, a heterocyclic group, an alkoxycarbonyl group, an aryloxycarbonyl group, or a carbamoyl group. The appropriate number of carbon atoms contained in each of these groups and the suitable examples of each of these groups are the same as those recited with respect to each of their corresponding groups in the illustration of $R_1$.

$R_3$ represents a hydrogen atom, an alkyl group, an alkenyl group, an alkynyl group, an aryl group or a heterocyclic group. The appropriate number of carbon atoms contained in each of these groups and the suitable examples of each of these groups are the same as those recited with respect to each of their corresponding groups in the illustration of $R_1$.

The groups recited above as those which $R_1$, $R_2$ and $R_3$ each can represent may further have substituent groups. Suitable examples of such substituent groups include the groups described above as the substituent groups which $R_1$ can represent.

The desirable range of compounds represented by formula (SC-1) is described below.

The desirable group for $R_1$ includes an alkyl group, an alkoxy group, an amino group, an anilino group, a carbonamido group, a sulfonamido group, an alkoxycarbonyl group and a cyano group, preferably an alkyl group, an alkoxy group, an anilino group and a carbonamido group. The desirable group for $R_2$ includes an alkyl group, an alkoxycarbonyl group and a carbamoyl group, preferably alkyl groups containing 1 to 8 carbon atoms, particularly preferably a methyl group. And the desirable group for $R_3$ includes an alkyl group and an aryl group.

Examples of a compound represented by formula (SC-1) are illustrated below. However, these examples should not be construed as limiting the scope of the invention in any way.

(SCC-1)

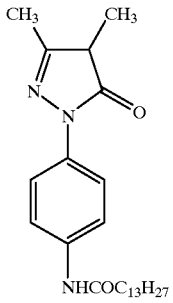

(SCC-2)

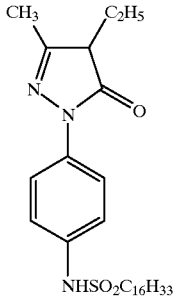

-continued (SCC-3)

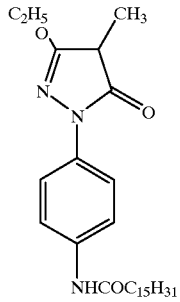

(SCC-4)

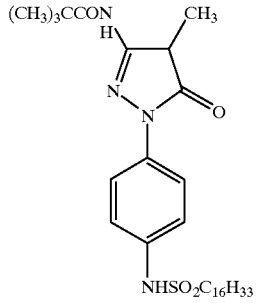

(SCC-5)

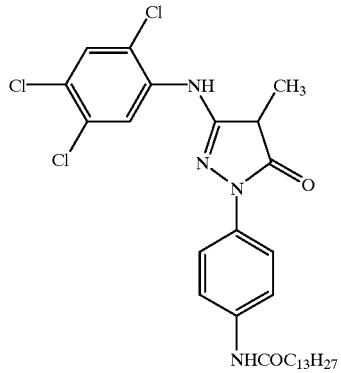

(SCC-6)

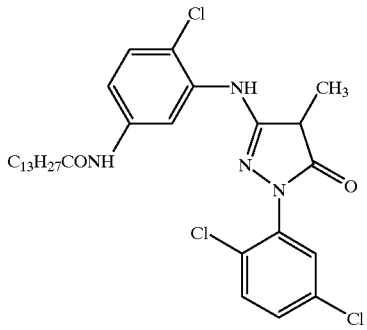

-continued (SCC-7)

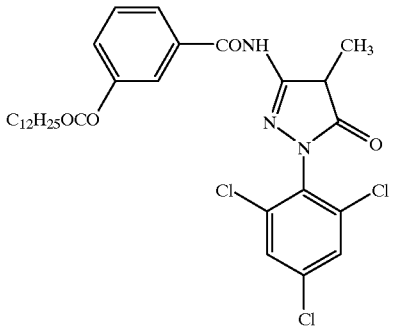

(SCC-8)

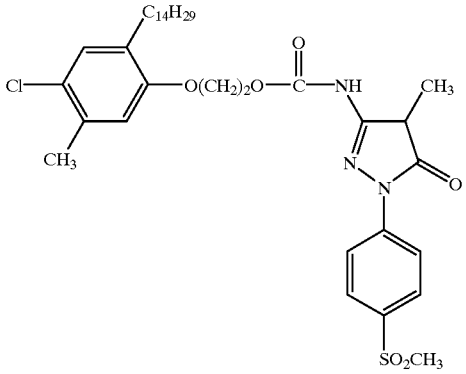

(SCC-9)

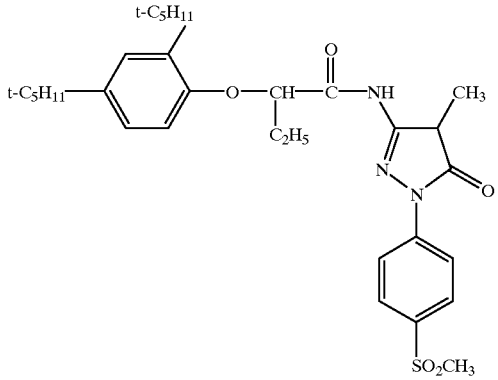

(SCC-10)

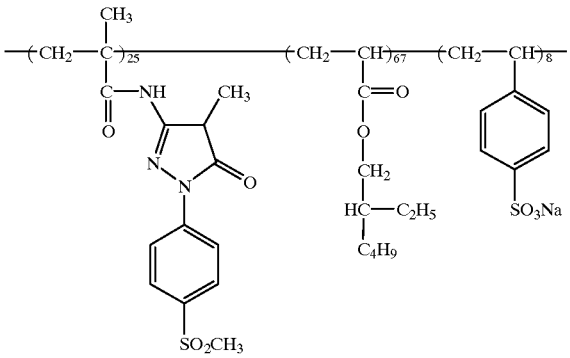

-continued (SCC-11)

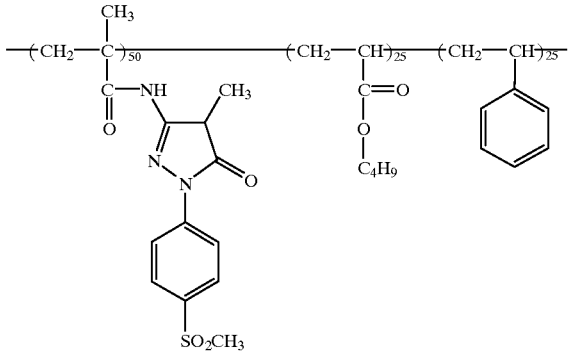

The compounds represented by formula (SC-1) can be synthesized using the methods disclosed in U.S. Pat. No. 3,876,428, German Patent Application OLS No. 2,428,431, and JP-A-62-7051.

Next, the compounds represented by formula (SC-2) are illustrated below in detail.

$R_4$ represents an alkyl group, an alkenyl group, an alkynyl group, an aryl group, a heterocyclic group, an alkoxy group, an aryloxy group, a heterocyclyloxy group, an amino group or an anilino group. The appropriate number of carbon atoms contained in each of these groups and suitable examples of each of these groups are the same as those recited with respect to each of their corresponding groups in the illustration of $R_1$.

$R_5$ represents an alkoxycarbonyl group, an aryloxycarbonyl group or a carbamoyl group. The appropriate number of carbon atoms contained in each of these groups and suitable examples of each of these groups are the same as those recited with respect to each of the their corresponding groups in the illustration of $R_1$.

$R_6$ represents an alkyl group, an alkenyl group, an alkynyl group, an acyl group or a heterocyclic group. The appropriate number of carbon atoms contained in each of these groups and suitable examples of each of these groups are the same as those recited with respect to each of their corresponding groups in the illustration of $R_1$. Further, $R_6$ may combine with $R_4$ to complete a 5- to 7-membered ring.

The desirable range of compounds represented by formula (SC-2) is described below.

The desirable group for $R_4$ includes an alkyl group, an aryl group, a heterocyclic group, an alkoxy group, an aryloxy group and an anilino group, preferably an alkyl group and an aryl group. The desirable group for $R_5$ includes an alkoxycarbonyl group and a carbamoyl group, preferably a carbamoyl group. And the desirable group for $R_3$ is an alkyl group. Of the compounds represented by formula (SC-2), the compounds represented by formula (SC-3) or (SC-4) are preferred over the others:

(SC-3)

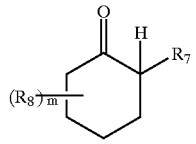

-continued (SC-4)

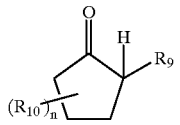

In formula (SC-3), $R_7$ has the same meaning as $R_5$ in formula (SC-2), $R_8$ has the same meaning as $R_1$ in formula (SC-1), and m represents an integer of 0 to 8. The desirable group for $R_7$ includes an alkoxycarbonyl group and a carbamoyl group, and the most desirable group therefore is a carbamoyl group. The desirable group for $R_8$ includes a halogen atom, an alkyl group, an alkenyl group, an alkynyl group, an aryl group, a heterocyclic group, an alkoxycarbonyl group, an aryloxycarbonyl group and a carbamoyl group. The desirable number for m is from 0 to 2, and the most desirable number for m is 0.

In formula (SC-4), $R_9$ has the same meaning as $R_5$ in formula (SC-2), $R_{10}$ has the same meaning as $R_1$ in formula (SC-1), and n represents an integer of 0 to 6. The desirable group for $R_9$ includes an alkoxycarbonyl group and a carbamoyl group, and the most desirable group therefor is a carbamoyl group. The desirable group for $R_{10}$ includes a halogen atom, an alkyl group, an alkenyl group, an alkynyl group, an aryl group, a heterocyclic group, an alkoxycarbonyl group, an aryloxycarbonyl group and a carbamoyl group. The desirable number for n is from 0 to 2, and the most desirable number for n is 0.

Suitable examples of a compound represented by formula (SC-2) are illustrated below. However, these examples should not be construed as limiting the scope of the invention in any way.

(SCC-12)

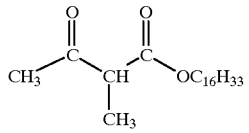

(SCC-13)

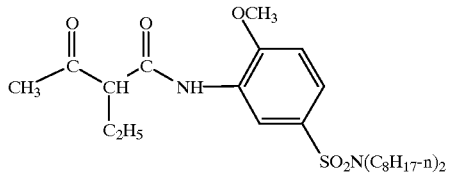

(SCC-14)

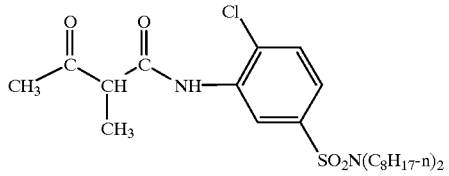

-continued (SCC-15)

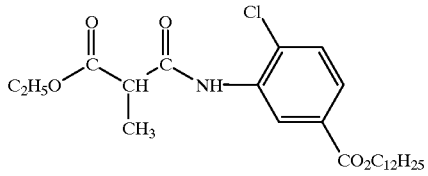

(SCC-16)

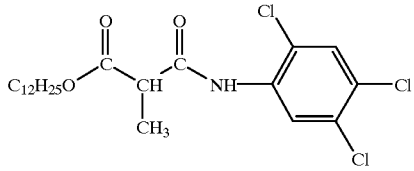

(SCC-17)

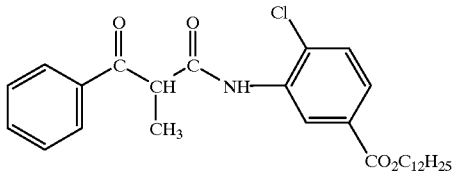

(SCC-18)

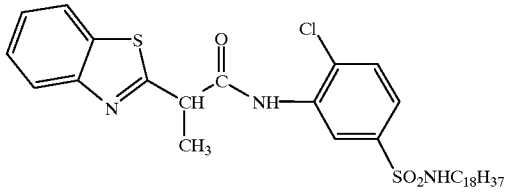

(SCC-19)

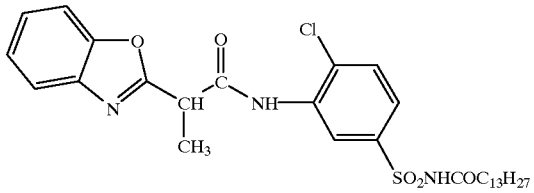

(SCC-20)

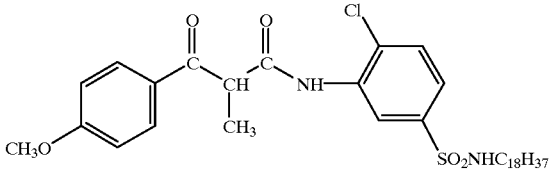

(SCC-21)

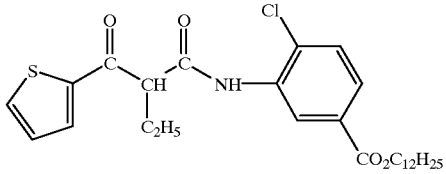

-continued
(SCC-22)
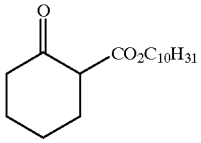
(SCC-23)
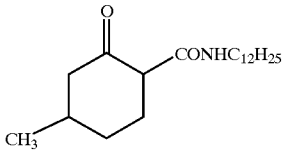
(SCC-24)
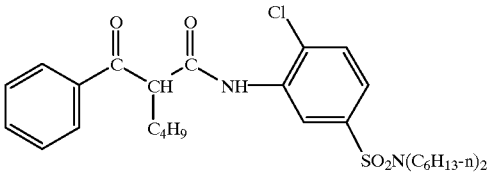
(SCC-25)
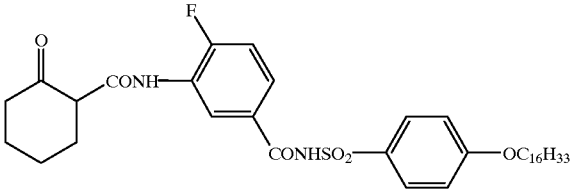
(SCC-26)
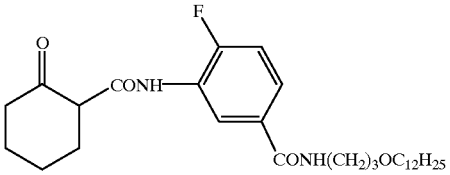
(SCC-27)
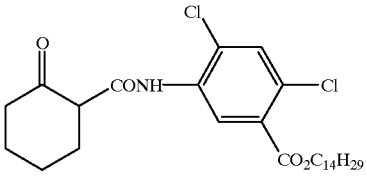
(SCC-28)
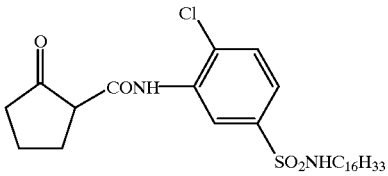
(SCC-29)
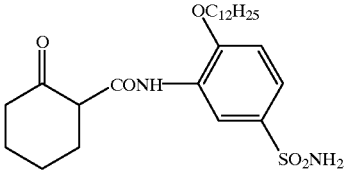
-continued
(SCC-30)
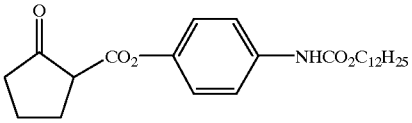
(SCC-31)
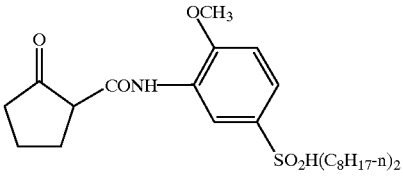
(SCC-32)
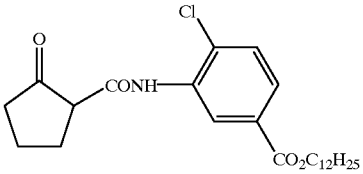
(SCC-33)
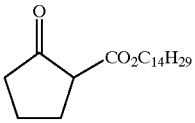
(SCC-34)
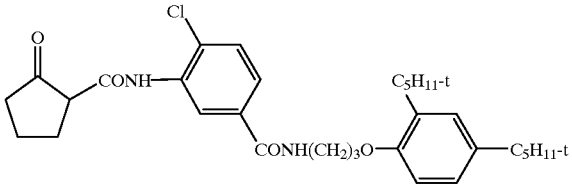
(SCC-35)
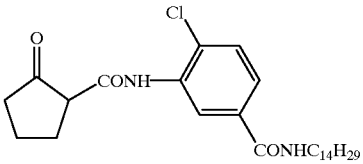
(SCC-36)
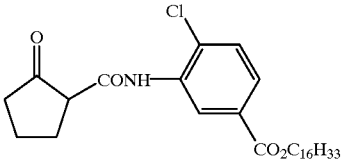
(SCC-37)
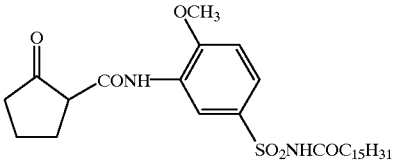

-continued (SCC-38)

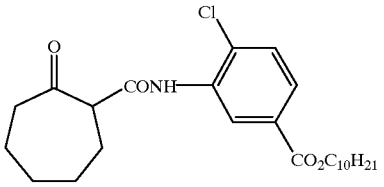

The compounds represented by formula (SC-2) can be synthesized using the method described in DE 19629142 A1.

It is desirable that the compound represented by formula (SC-1) or (SC-2) be contained in the proportion of 5 to 100 mole %, particularly 10 to 60 mole %, to the total amount of developing agents present in the layer to which the compound is added and the layers adjacent to this compound-added layer.

The compounds represented by formula (II) are illustrated below in detail.

A in formula (II) represents a coupler residue or a redox group.

Examples of a coupler residue represented by A in formula (II) include coupler residues of pivaloylacetanilide type, those of benzoylacetanilide type, those of malondiester type, those of malondiamide type, those of benzoylmethane type, those of benzothiazolylacetamide type, those of malonestermonoamide type, those of benzoxazolylacetamide type, those of benzimidazolylacetamide type and those of cycloalkanoylacetamide type. Therein, the coupler residues disclosed in U.S. Pat. Nos. 5,021,332 and 5,021,330, and EP-A-0421221 may further be included. Furthermore, the coupler residues represented by A may include coupler residues of 5-pyrazolone type, those of pyrazolobenzimidazole type, those of pyrazolotriazole type, those of pyrazoloimidazole type and those of cyanoacetophenone type. In addition to these coupler residues, the coupler residues disclosed in U.S. Pat. No. 4,746,602 and EP-A-0249453 may also be included.

Besides the coupler residues recited above, A may be a coupler residue leaving no color image in a substantial sense. Examples of a coupler residue of such a type include coupler residues of indanone type, those of acetophenone type and the elution type coupler residues disclosed in EP-A-0443530 and EP-A-0444501.

Specifically, the coupler residues described hereinafter can be employed as A.

When A in formula (II) represents a redox group, on the other hand, the redox group signifies a group which can be cross-oxidized by the oxidation product of a developing agent, with examples including groups derived from hydroquinones, catechols, pyrogallols, 1,4-naphthohydroquinones, 1,2-naphthohydroquinones, sulfonamidophenols, hydrazines and sulfonamidonaphthols. Specifically, such redox groups include the groups disclosed in JP-A-61-230135, JP-A-62-251746, JP-A-61-278852, U.S. Pat. Nos. 3,364,022, 3,379,529, 3,639,417 and 4,684,604, and J. Org. Chem., 29, 588 (1964).

The linkage groups represented by $L_1$ and $L_2$ in formula (II) include the groups utilizing the cleavage reaction of hemiacetals as disclosed in U.S. Pat. Nos. 4,146,396, 4,652,516 and 4,698,297, the timing groups inducing the cleavage reaction by utilizing intramolecular nucleophilic reaction as disclosed in U.S. Pat. Nos. 4,248,962, 4,857,440 and 4,847,185, the timing groups inducing the cleavage reaction by utilizing electron transfer reaction as disclosed in U.S. Pat. Nos. 4,409,323 and 4,421,845, the groups inducing the cleavage reaction by utilizing the hydrolysis reaction of iminoketals as disclosed in U.S. Pat. No. 4,546,073, and the groups inducing the cleavage reaction by utilizing the hydrolysis reaction of esters as disclosed in West German Patent Application OLS No. 2,626,317. $L_1$ and $L_2$ are bonded to A and $A—(L_1)_a—(B)_m$ respectively at the site of the heteroatom, preferably oxygen, sulfur or nitrogen atom, contained therein.

The group represented by B in formula (II) is a group which turns into a redox group or a coupler residue after parting from the moiety $A—(L_1)_a$. Such a redox group and such a coupler residue include the same ones as recited in the illustration of A. The group represented by B has a group which parts from B upon reaction with the oxidation product of a developing agent (namely, a group bonded to B on the right side in formula (II)). Examples of a group represented by B include the groups represented by B in U.S. Pat. No. 4,824,772, the groups represented by COUP in U.S. Pat. No. 4,438,193 and the groups represented by RED in U.S. Pat. No. 4,618,571. It is desirable for the group B to be bonded to the moiety $A—(L_1)_a$ at the site of a hetero atoms, preferably oxygen or nitrogen atom, contained therein.

The photographically useful group represented by PUG in formula (II) is a group capable of turning into a development inhibitor, a development accelerator, a desilvering accelerator (bleach accelerator), a fogging agent, a nucleating agent, a dye, a hardener, a coupler, an oxidized developing agent scavenger, a fluorescent dye, a developing agent, a chelating agent or a electron transmitting agent (electron transferring agent), or a precursor thereof.

The groups hitherto known as photographically useful groups are usable as PUG in formula (II). Examples of such known groups include the photographically useful groups disclosed in U.S. Pat. Nos. 4,248,962, 4,409,323, 4,438,193, 4,421,845, 4,618,571, 4,652,516, 4,861,701, 4,782,012, 4,857,440, 4,847,185, 4,477,543, 4,438,193, 4,628,024, 4,618,571 and 4,741,994, EP-A-0193389, EP-A-0348139 and EP-A-0272573.

Of those groups, the groups preferred as PUG are groups capable of turning into a development accelerator, an electron transmitting agent (electron transferring agent), a developing agent, a desilvering accelerator (bleach accelerator), a chelating agent, a fogging agent and a dye respectively.

When PUG is a group capable of turning into a desilvering accelerator (bleach accelerator), the following are preferred as PUG:

$—S—R_3—COOH$ $—S—R_3—OH$ $—S—R_3—N(R_4)R_5$ $—S—R_6—COOH$

Therein, $R_3$ represents an alkylene group containing 1 to 8, preferably 1 to 4, carbon atoms. Such an alkylene group may have in its main chain a divalent group, such as —O—, —CO—, —COO—, —CONH—, —S—, $—SO_2—$ or $—SO_2NH—$ ($R_3$ may be, e.g., $—(CH_2)_2—S—CH_2—$). $R_6$ represents a divalent group containing a heterocyclic group (specifically, a 5- or 6-membered, saturated or unsaturated, substituted or unsubstituted heterocyclic group containing 1 to 10, preferably 1 to 5, carbon atoms and at least one hetero atom, such as a nitrogen, oxygen or sulfur atom, with examples including divalent groups derived from a triazole ring and a tetrazole ring), or a phenylene group. $R_4$ and $R_5$ each represent an alkyl group containing 1 to 6, preferably 1 to 3, carbon atoms.

When PUG represents a group capable of turning into a development inhibitor, the group can be a heterocyclylthio group or a nitrogen-containing heterocyclic group. The heterocyclic moiety therein is a saturated or unsaturated, substituted or unsubstituted, preferably 5-membered, heterocyclic group containing 1 to 4 carbon atoms and at least one hetero atom (e.g., nitrogen, oxygen or sulfur atom). Suitable example of such groups include tetrazolylthio, thiadiazolylthio, oxadiazolylthio, triazolylthio, imidazolylthio, benzimidazolylthio, benzothiazolylthio, benzotriazolyl, 1,2,3-triazolyl, 1,2,4-triazolyl and tetrazolyl groups. These groups capable of turning into development inhibitors include not only unsubstituted but also substituted ones. Suitable examples of a substituent group the above-recited groups can have include an alkoxycarbonyl group, an aryloxycarbonyl group, an alkyl group, a nitro group, an aryl group, a halogen atom, a hydroxyl group, an acylamino group and an alkoxy group.

When PUG represents a group capable of turning into a dye, the PUG may be bonded at the site of auxochrome (or chromophore), or not. In the former case, the PUG takes on the intended hue when it is split off at the time of development-processing, and serves as dye. In the latter case, the coupler represented by formula (II) has the intended hue in itself, and so it is desirable for the PUG released upon development-processing to be eluted (or decolorized) from the photographic layer. Suitable examples of such a dye include azo dyes, azomethine dyes, quinone dyes and benzylidene dyes. The following is a desirable example of the group capable of turning into a dye:

$$—V—R_7—N{=}N—R_8$$

wherein V represents an oxygen atom, a sulfur atom or an imino group (—$NR_9$—: $R_9$ is an alkyl or aryl group), $R_7$ represents an arylene or a divalent unsaturated heterocyclic group, and $R_8$ represents an aryl group or an unsaturated heterocyclic group.

When PUG is a group capable of turning into an electron transferring agent, suitable examples of the electron transferring agent include 3-pyrazolidones.

When PUG is a group capable of turning into a fogging agent, suitable examples of such a group include heterocyclylthio groups having a partial structure of hydrazide as a substituent group and heterocyclic groups (preferably benzotriazolyl groups) having the same substituent group as the above.

When PUG is a group capable of turning into a developing agent, suitable examples of such a developing agent include 3-pyrazolidones, hydroquinones, p-phenylenediamines, sulfones, acid phenols and carbamoylhydrazines.

When PUG is a group capable of turning into a chelating agent, it is desirable for such a chelating agent to be ethylenediaminetetraacetic acid or picolinic acid.

The case in which PUG is a group capable of turning into a development inhibitor is described below in more detail.

Examples of such a development inhibitor include those disclosed in *Research Disclosure* (hereinafter abbreviated as "RD"), vol. 76 Item 17643 (Dec., 1978), U.S. Pat. Nos. 4,477,563, 5,021,332, 5,026,628, 3,227,554, 3,384,657, 3,615,506, 3,617,291, 3,733,201, 3,933,500, 3,958,993, 3,961,959, 4,149,886, 4,259,437, 4,095,984 and 4,782,012, and U.K. Patents 1,450,478 and 5,034,311. Specifically, the development inhibitors from a heterocyclylthio group, a heterocyclylseleno group and a triazolyl group (a monocyclic or condensed 1,2,3-triazolyl or 1,2,4-triazolyl group) respectively are favorable. In particular, tetrazolylthio, tetrazolylseleno, 1,3,4-oxadiazolylthio, 1,3,4-thiadiazolylthio, 1-(or 2-)benzotriazolyl, 1,2,4-triazole-1-(or 4-)yl, 1,2,3-triazole-1-yl, 2-benzothiazolylthio, 2-benzoxazolylthio, 2-benzoimidazolylthio and the derivatives thereof are preferred as the groups which can turn into development inhibitors. More specifically, the preferred development inhibitors are those from groups represented by the following formulae DI-1 to DI-6:

DI-1

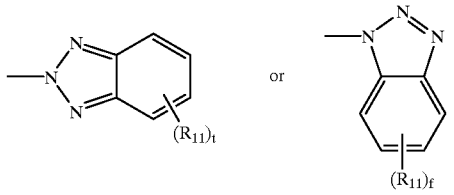

DI-2

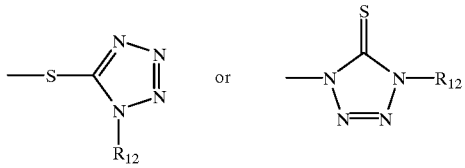

DI-3

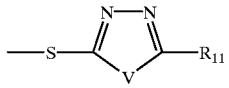

DI-4

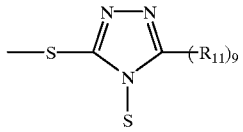

DI-5

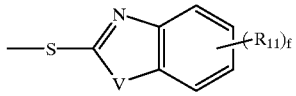

DI-6

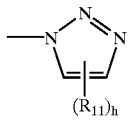

In the foregoing formulae, R11 represents a halogen atom (e.g., bromine, chlorine), an alkoxycarbonyl group (containing 2 to 20, preferably 2 to 10, carbon atoms, such as methoxycarbonyl or isoamyloxycarbonyl), an acylamino group (containing 2 to 20, preferably 2 to 10, carbon atoms, such as hexanamido or benzamido), a carbamoyl group (containing 1 to 20, preferably 1 to 10, carbon atoms, such as N-butylcarbamoyl, N,N-diethylcarbamoyl or N-mesylcarbamoyl), a sulfamoyl group (containing 1 to 20, preferably 1 to 10, carbon atoms, such as N-butylsulfamoyl), an alkoxy group (containing 1 to 20, preferably 1 to 10, carbon atoms, such as methoxy or benxyloxy), an aryloxy group (containing 6 to 10, preferably 6 to 8, carbon atoms, such as phenoxy, 4-methoxyphenoxy or naphthoxy), an aryloxycarbonyl group (containing 7 to 21, preferably 7 to 11, carbon atoms, such as phenoxycarbonyl), an alkoxycarbonylamino group (containing 1 to 20, preferably 1 to 10, carbon atoms, such as ethoxycarbonylamino), a cyano group, a nitro group, an alkylthio group (containing 1 to 20, preferably 1 to 10, carbon atoms, such as methylthio or hexylthio), an ureido group (containing 1 to 20, preferably 1 to 10, carbon atoms, such as N-phenylureido), an aryl group (containing 6 to 10 carbon atoms, such as phenyl, naphthyl or 4-methoxyphenyl), a heterocyclic group (specifically, a 3- to 12-membered, preferably 5- or 6-membered, heterocyclic group containing 1 to 10 carbon atoms and at least one hetero atom (e.g., nitrogen, oxygen or sulfur), which may have a monocyclic or condensed ring; with examples including 2-pyridyl, 1-pyrrolyl, morpholino and indolyl), an alkyl group (specifically, a straight-chain, branched or cyclic, saturated or unsaturated alkyl group containing 1 to 20, preferably 1 to 10, carbon atoms, with examples including methyl, ethyl, butoxycarbonyl methyl, 4-methoxybenzyl and benzyl), an arylthio group (containing 6 to 10, preferably 6 to 8, carbon atoms, such as phenylthio or naphthylthio), or an aryloxycarbonylamino group (containing 7 to 11 carbon atoms, such as phenoxycarbonylamino). These groups each may further have a substituent group. Examples of such a substituent group include the groups recited above.

$R_{12}$ represents an aryl group (containing 6 to 10 carbon atoms, such as phenyl, naphthyl, 4-methoxyphenyl or 3-methoxycarbonylphenyl), a heterocyclic group (specifically, a 3- to 12-membered, preferably 5- or 6-membered, heterocyclic group containing 1 to 10 carbon atoms and at least one hetero atom (e.g., nitrogen, oxygen or sulfur), which may have a monocyclic or condensed ring; with examples including 2-pyridyl, 1-pyrrolyl, morpholino and indolyl), or an alkyl group (specifically, a straight-chain, branched or cyclic, saturated or unsaturated alkyl group containing 1 to 20, preferably 1 to 10, carbon atoms, with examples including methyl, ethyl, butoxycarbonylmethyl, 4-methoxybenzyl and benzyl).

V represents an oxygen atom or a sulfur atom/ f is an integer from 1 to 4, g is 0 or 1, and h is 1 or 2.

For the compound of formula (II), it is desirable that p be 0 or 1.

Further, it is desirable for the coupler represented by formula (II) to be nondiffusible. In particular, it is preferable that the nondiffusible group be contained in A, $L_1$ or B.

Of the compounds represented by formula (II), those having a coupler residue as A are especially preferred.

Further, those having as PUG a group capable of turning into a development inhibitor are advantageous over the others.

The compounds particularly preferred as those represented by formula (II) fall under one of the following three cases:

a=1, m=0, p=1 and n=0, a=0, m=1, p=1 and n=0, or a=1, m=0, p=1 and n=1.

These compounds are particularly superior in color reproduction attributable to interlayer effect and sharpness ascribable to edge effect.

Other examples of a coupler represented by formula (II) and synthetic methods therefor are described in the references cited for the illustration of A, $L_1$, B and $L_2$ in formula (II), JP-A-63-36346 and JP-A-61-156127.

Concrete examples of a coupler represented by formula (II) are illustrated below, but these examples should not be construed as limiting on the scope of the invention.

The following Compounds II-1 to II-23 are adduced as examples of a case that PUG is a group capable of turning into a development inhibitor.

(II-1)

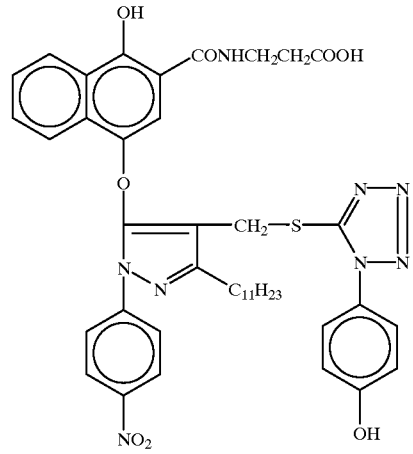

(II-2)

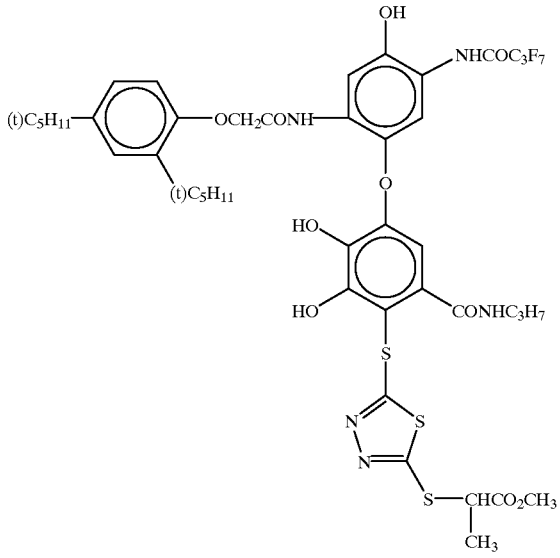

(II-3)

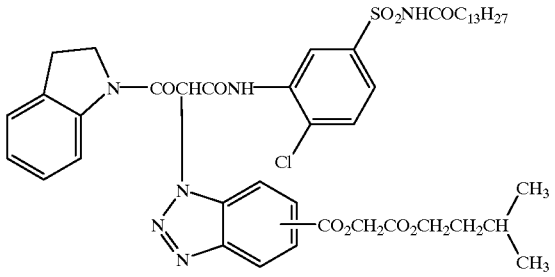

-continued
(II-4)
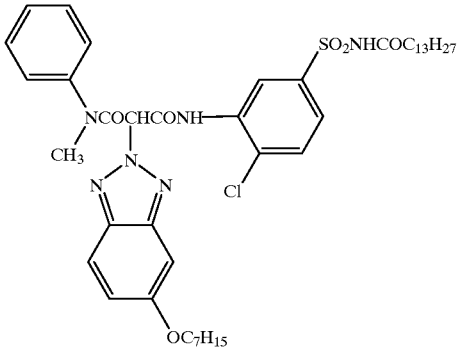
(II-5)
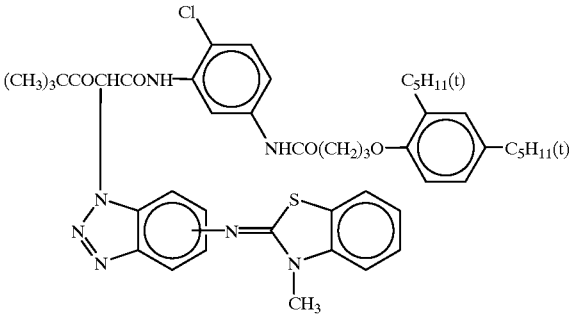
(II-6)
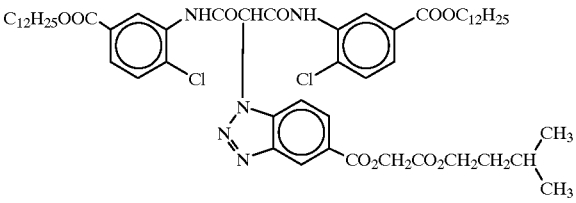
(II-7)
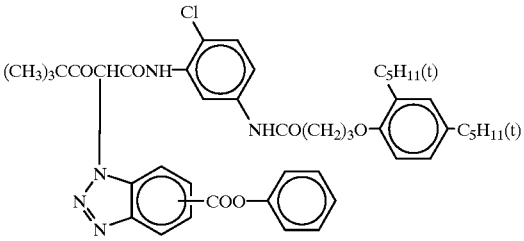
(II-8)
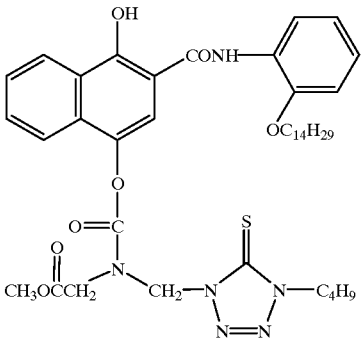
-continued
(II-9)
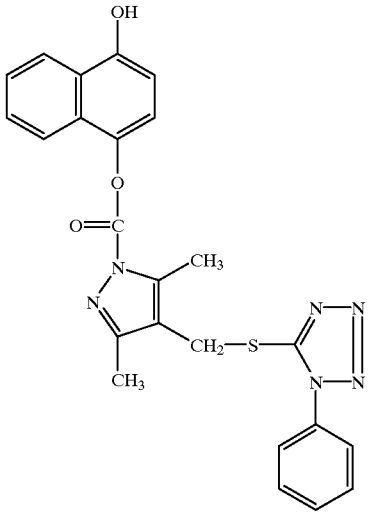
(II-10)
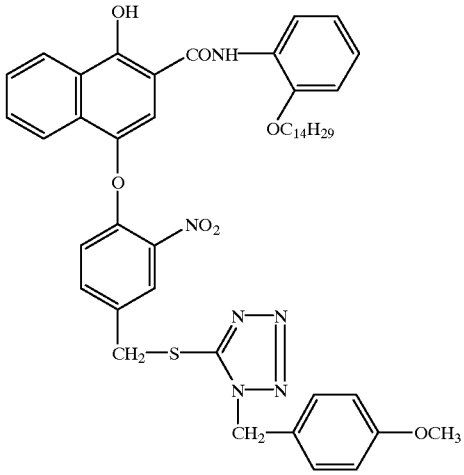
(II-11)
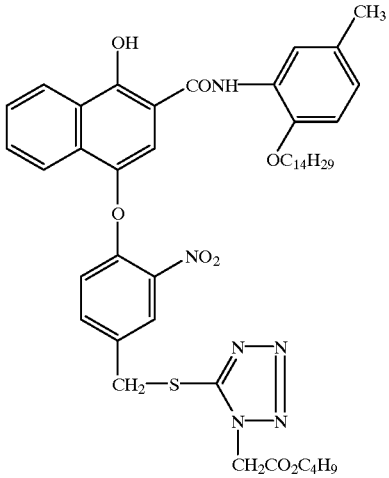

-continued
(II-12)
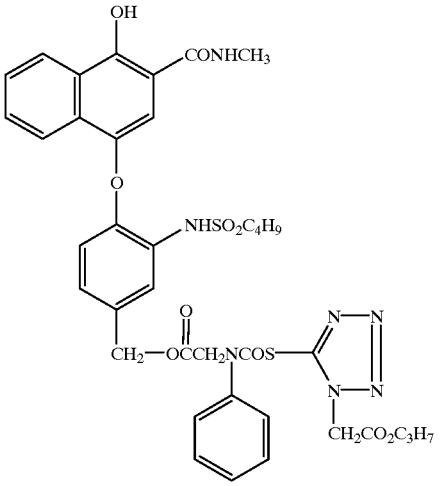
(II-13)
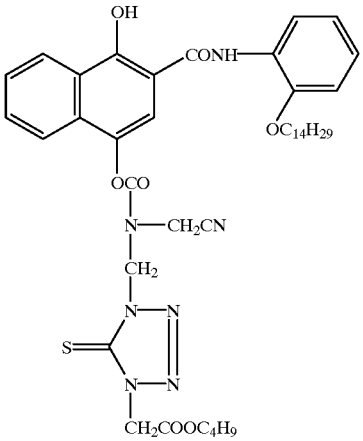
(II-14)
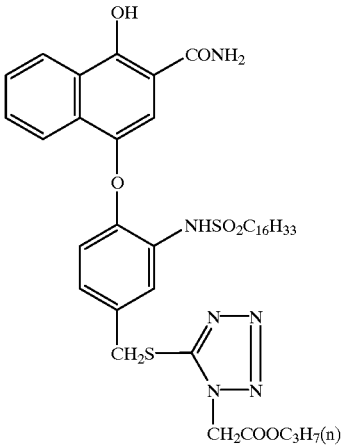
-continued
(II-15)
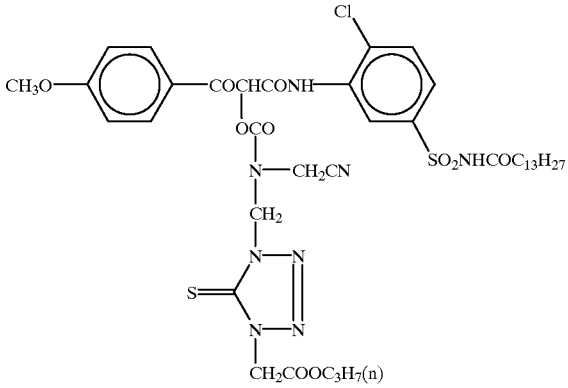
(II-16)
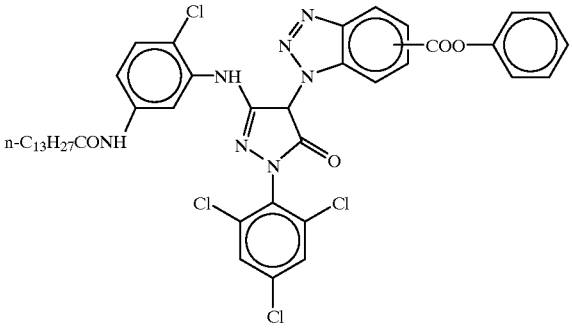
(II-17)
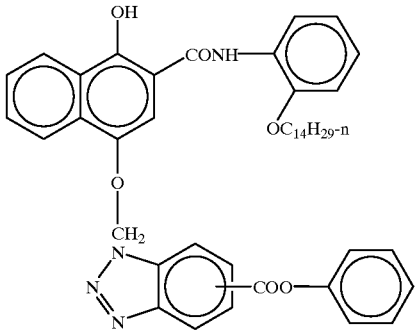
(II-18)
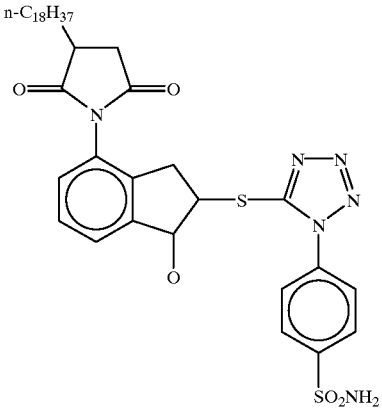

-continued (II-19)

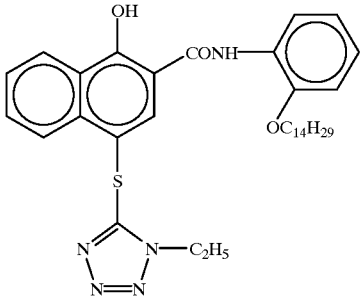

(II-20)

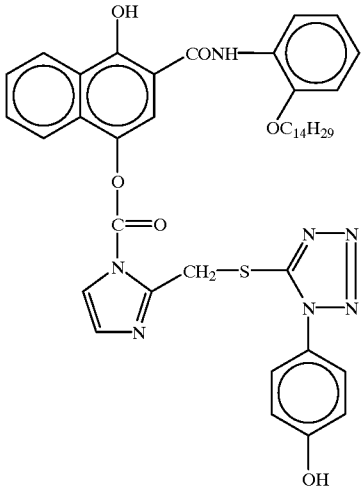

(II-22)

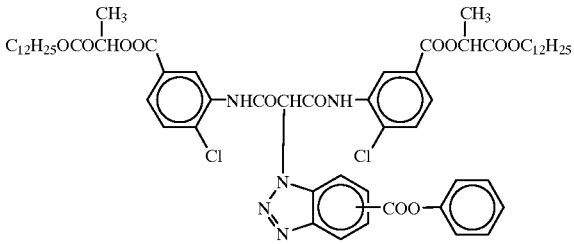

(II-24)

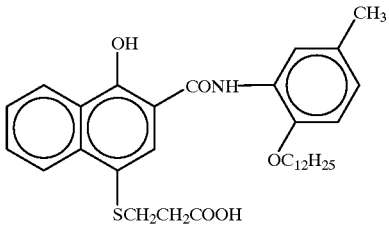

-continued (II-23)

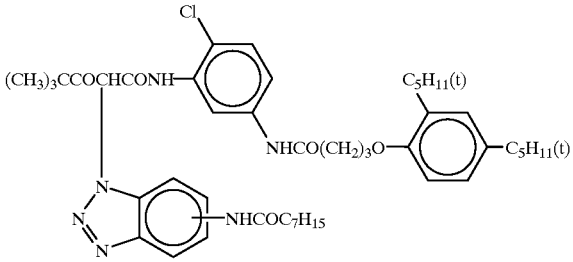

The following Compounds II-24 and II-25 are adduced as examples of a case that PUG is a group capable of turning into a bleach accelerator, the following Compounds II-26, II-28, II-29 and II-30 are adduced as examples of a case that PUG is a group capable of turning into a dye, and the following Compound II-27 is adduced as an example of a case that PUG is a group capable of turning into a chelating agent.

(II-25)

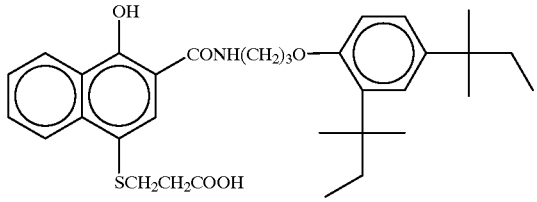

-continued
(II-26)
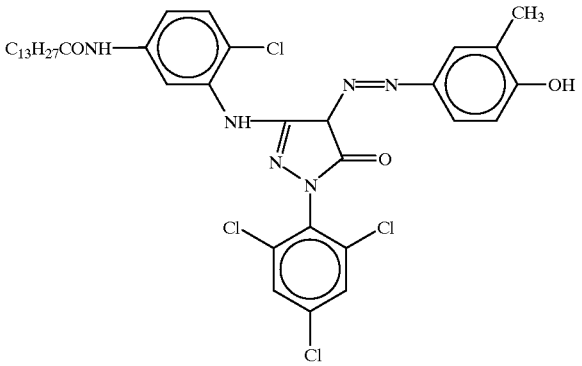
(II-27)
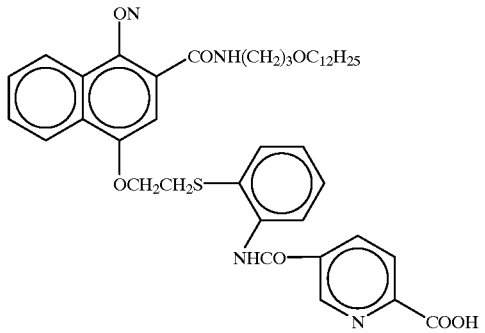
(II-28)
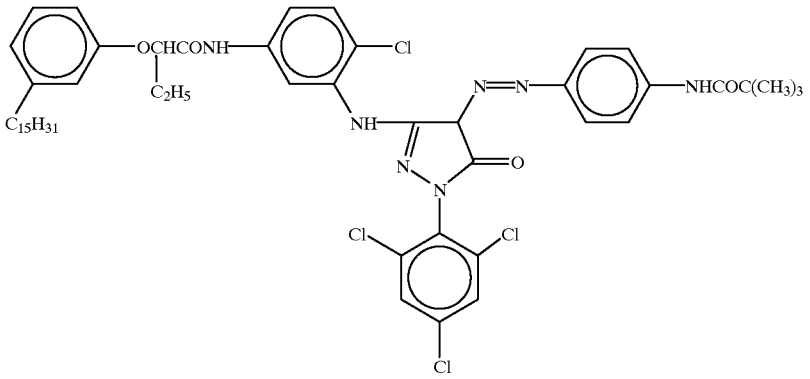
(II-29)
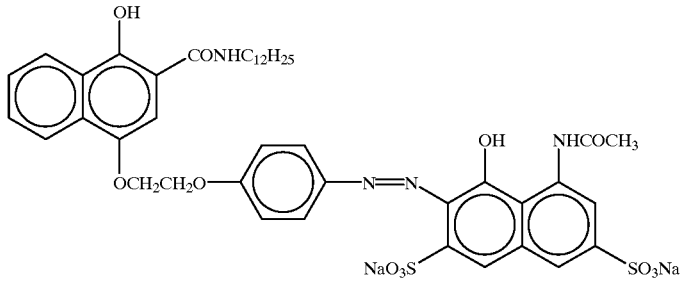

-continued
(II-30)
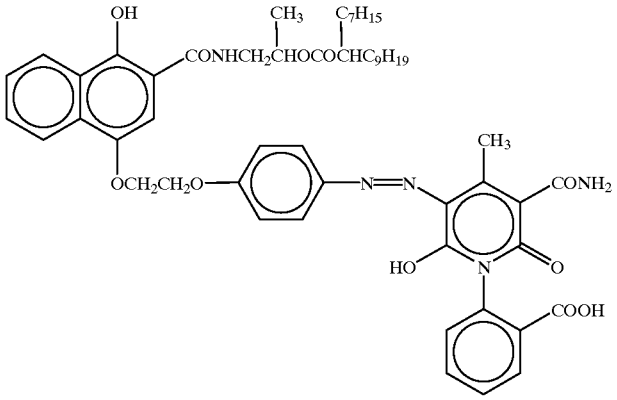
The following Compounds II-31 and II-32 are adduced as examples of a case that PUG is a group capable of turning into a development accelerator (fogging agent).
(II-31)
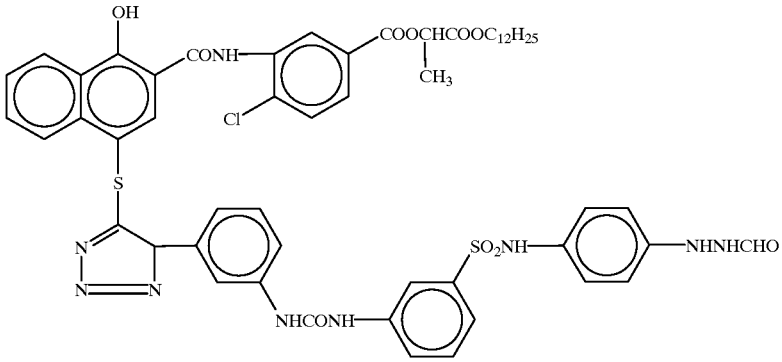
(II-32)
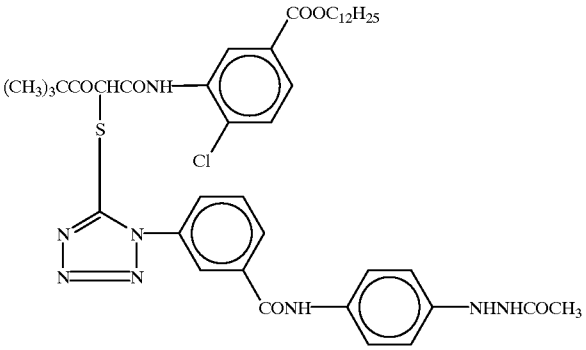

The following Compound II-33 is adduced as an example of a case that PUG is a group capable of turning into a developing agent, and the following Compound II-34 is adduced as an example of a case that PUG is a group capable of turning into an electron transferring agent.

(II-33)

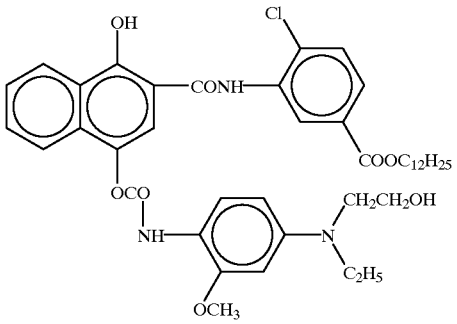

(II-34)

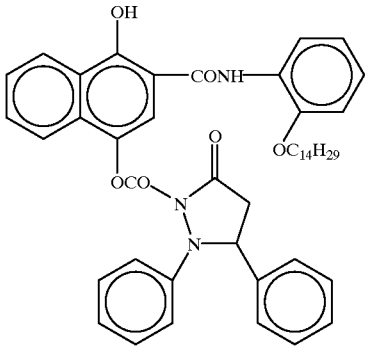

The present couplers represented by formula (II) are used in an amount of $10^{-6}$ to $2\times10^{-3}$ mole, preferably $10^{-5}$ to $10^{-3}$ mole, particularly preferably $2\times10^{-5}$ to $5\times10^{-4}$ mole, per $m^2$ of a silver halide color photographic material. The couplers represented by formula (II) may be used in any of the constituent layers (sensitive or insensitive to light) of a photographic material. One and the same compound of formula (II) may be used in at least two layers, and a mixture of at least two compounds of formula (II) may be used in one layer.

The present invention is based on a discovery that, when a photographic element containing couplers and a developing agent having very high stability in the absence of a base and a processing element containing a base and/or a base precursor are used in combination and these elements undergo heat development in the presence of a small amount of water to form images of non-diffusible dyes in the photographic element, the dye images formed have excellent graininess and high sharpness, and the output of image information from the photographic element onto another recording material, such as color paper or a heat-developable color print material, can provide color images of very high quality. Further, the invention enables the rapid development, satisfying high keeping stability required for photograph-taking materials, because the photographic material is isolated from the base before it undergoes development.

After the developed color images are formed by heat development, the remaining silver halide and/or developed silver may not be removed from the present photographic material. And the image information from the present photographic material may be outputted onto another material by usual projection exposure, or may be read photoelectrically by intensity measurement of transmitted light to be outputted as electric signals. The material onto which the image information is outputted may not be a photosensitive material, but may be, e.g., a sublimation type heat-sensitive recording material, an ink jet recording material, an electrophotographic material or a full-color direct heat-sensitive recording material.

In accordance with an embodiment preferred in the invention, the image information from the developed color images formed by heat development is read photoelectrically by transmission density measurement using diffused light and CCD image sensor without carrying out an additional removal processing of the remaining silver halide and developed silver, converted to digital signals, subjected to image processing, and then outputted by means of a heat-developable color printer, e.g., Pictrography 3000 (trade name, a product of Fuji Photo Film Co., Ltd.). In this case, prints of good quality can also be obtained rapidly without using any processing solutions as used in conventional color photography. Further, as the foregoing digital signals can be arbitrarily processed and edited, the shot image can be freely retouched, deformed and processed, and the resultant image information can be outputted.

The preferred embodiment of the invention is illustrated below in more detail.

The photographic material used in the invention is a color photographic material having on a transparent support at least three photosensitive layers, which each comprise at least light-sensitive silver halide grains, a coupler and a binder, and which are different in each individual sensitivity wavelength region and/or the absorption wavelength region of the dye formed from a color developing agent and each coupler. While the color developing agent can be applied as a processing solution or paste to the photographic material from the outside in the processing step, it is desirable for the color developing agent to be incorporated together with the coupler in the photographic material.

Also, the base and/or the base precursor can be supplied as a processing solution or a processing paste to the photographic material from the outside. However, it is desirable to adopt a method of supplying a base and/or base precursor to the photographic material by preparing a processing element having on a support a processing layer comprising the base and/or base precursor and bringing the processing layer into a face-to-face contact with the surface of the photographic material on the side on light-sensitive layers in the presence of water in an amount corresponding to from 1/10 to 10/10 of the amount required for the maximum swelling in the coating layers of the photographic material and the processing element, except in the backing layers thereof.

The silver halide usable in the present photographic material may be any of silver iodobromide, silver bromide, silver chlorobromide, silver iodochloride, silver chloride and silver iodochlorobromide. The appropriate size of each silver halide grain is from 0.1 to 2 $\mu$m, especially 0.2 to 1.5 $\mu$m, based on the diameter of a sphere having the same volume as the grain. Besides being used as the light-sensitive silver halide grains described above, those silver halide grains can be employed as light-insensitive silver halide grains by not undergoing chemical sensitization.

As to the grain shape, silver halide grains having a regular crystal form, such as that of a cube, octahedron or tetradecahedron, and those having a crystal form of hexagonal or rectangular tablet can be used. Of these grains, tabular grains having an aspect ration of at least 2, preferably at least 8, particularly at least 20, are used to advantage. Herein, the term aspect ration is defined as the ration of the projected area diameter to the thickness of each grain. In the light-sensitive emulsions used in the invention, it is desirable that the proportion of those tabular grains to the total silver halide grains be at least 50%, preferably at least 80%, particularly preferably at least 90%, on a projected area basis.

The appropriate thickness of those tabular grains is at most 0.3 μm, preferably at most 0.2 μm, particularly preferably at most 0.1 μm.

It is also desirable to use the grains having a grain thickness smaller than 0.07 μm and a higher aspect ratio as disclosed, e.g., in U.S. Pat. Nos. 5,494,789, 5,503,970, 5,503,971 and 5,536,632.

Besides those tabular grains, the tabular silver halide grains having a high chloride content and the (111) face as main plane as disclosed, e.g., in U.S. Pat. Nos. 4,400,463, 4,713,323 and 5,217,858, and the tabular silver halide grains having a high chloride content and the (100) face as main plane as disclosed, e.g., in U.S. Pat. Nos. 5,264,337, 5,292,632 and 5,310,655 can be advantageously employed.

The cases wherein those tabular silver halide grains are actually used are disclosed in Japanese Patent Application Nos. 8-46822, 8-97344, 8-238672 and 9-41637. It is desirable that the silver halide grains used in the invention be the so-called monodisperse grains having a narrow distribution of grain sizes. When the variation coefficient obtained by dividing the standard deviation of grain size distribution by an average grain size is adopted as a standard for judging whether the grains are monodisperse or not, the variation coefficient suitable for monodisperse grains is at most 25%, preferably at most 20%. Also, it is desirable that the halide composition be uniform among the grains.

The interior of the present silver halide grains may be uniform in halide composition, or therein a region different in halogen composition may be introduced intentionally. In order to achieve high sensitivity, it is particularly desirable that the grains have a layered structure made up of a core and a shell which are different from each other in halide composition. In addition, it is also desirable that the grains be made to further grow after the introduction of a region having a different halide composition, thereby intentionally introducing dislocation lines. On the apices or edges of the host grains formed, it is also desirable that the epitaxial junctions be furthermore formed by guest crystals having a different halide composition.

Moreover, it is desirable that the interior of the present silver halide grains be doped with polyvalent transition metal ions or polyvalent anions as impurities. For the former dopants, the halogeno, cyano or organic ligands complexes containing iron family elements as their respective central metals are used advantageously.

It is generally desirable for the present emulsions to be chemically and spectrally sensitized.

For chemical sensitization, the chalcogen sensitization methods using sulfur, selenium or tellurium coompounds, the precious metal sensitization methods using gold, platinum or iridium compounds, or the so-called reduction sensitization method enabling the achievement of high sensitivity by introduction of reductive silver nuclei can be employed individually or in combination of two or more thereof.

For spectral sensitization, the so-called spectral sensitizing dyes which are adsorbed to silver halide grains to confer thereon sensitivities in their own adsorption wavelength regions, such as cyanine dyes, merocyanine dyes, complex cyanine dyes, complex merocyanine dyes, holopolar dyes, hemicyanine dyes, styryl dyes and hemioxonol dyes, are used independently or in combination of two or more thereof. Also, it is favorable to use those dyes in combination with supersensitizers.

For the purpose of preventing the present silver halide emulsions from being fogged and enhancing their stability upon storage, the addition of various kinds of stabilizers is preferred. Suitable examples of a stabilizer usable therein include nitrogen-containing heterocyclic compounds, such as azaindenes, triazoles, tetrazoles and purines; and mercapto compounds such as mercaptotetrazoles, mercaptotriazoles, mercaptoimidazoles and mercaptothiadiazoles. In particular, the trizoles and the mercaptoazoles wherein an alkyl group containing at least 5 carbon atoms or an aromatic ring is contained as substituent group can effectively prevent the fog generation at the time of heat development, heighten the developability in the exposed area in some cases, and produce a remarkable effect on the achievement of high discrimination. As to the photographic additives suitable for the present silver halide emulsions, the additives disclosed in *Research Disclosure,* Item 17643 (December, 1978), Item 18716 (November, 1979), Item 307105 (November 1989) and Item 38957 (September, 1996) are used to advantage.

The light-sensitive silver halide is used at a coverage of 0.05 to 15 g/m$^2$, preferably 0.1 to 8 g/m$^2$, on a silver basis.

The suitable binders for the photographic material are hydrophilic ones, with examples including the binders disclosed in the above-cited Research Disclosures and JP-A-64-13546, pages 71–75. Of these binders, gelatin and the combination of gelatin with another water-soluble binder, such as polyvinyl alcohol, a modified polyvinyl alcohol, a cellulose derivative or an acrylamide polymer, are preferred. The appropriate coverage of binder is from 1 to 25 g/m$^2$, preferably from 3 to 20 g/m$^2$, particularly from 5 to 15 g/m$^2$. The appropriate proportion of gelatin to the total binders is from 50 to 100%, preferably 70 to 100%.

Examples of a developing agent usable in the invention include p-phenylenediamines and p-aminophenols. Suitable examples of these compounds include the sulfonamidophenols as disclosed in JP-A-8-110608, JP-A-8-122994, JP-A-8-146578, JP-A-9-15808 and JP-A-9-146248, the sulfonylhydrazines disclosed in EP-A-0545491, JP-A-8-166664 and JP-A-8-227131, the carbamoylhydrazines as disclosed in JP-A-8-286340, the sulfonylhydrazones disclosed in JP-A-8-202002, JP-A-10-186564 and JP-A-10-239793, and the carbamoylhydrazones disclosed in JP-A-8-234390.

Those developing agents are used individually or as a combination of two or more thereof, and the appropriate total amount of developing agents used is from 0.05 to 20 mmol/m$^2$, preferably from 0.1 to 10 mmol/m$^2$. In the present photographic material, couplers capable of forming dyes by coupling reaction with the oxidation products of those developing agents are incorporated. Suitable examples of such complex couplers include active methylene compounds, 5-pyrazolone compounds, pyrazolone compounds, phenol compounds, naphthol compounds and pyrrolotriazole compounds. Of the compounds of those types, the compounds recited in *Research Disclosure,* Item. 38957, pp. 616–624 (September, 1996) are preferably used.

The couplers used to particular advantage are the pyrazoloazole couplers as disclosed in JP-A-8-110608 and the pyrrolotriazole couplers as disclosed in JP-A-8-122994 and JP-A-9-218496.

The total amount of couplers used for each color is generally from 0.05 to 10 mmol/m$^2$, preferably from 0.1 to 5 mmol/m$^2$.

The photographic material is generally constituted of at least three light-sensitive layers differing in color sensitivity, and each light-sensitive layer contains at least one silver halide emulsion layer. In a typical case, each light-sensitive layer is constituted of two or more silver halide emulsion layers having the same color sensitivity but different photographic speeds. The desirable shape of silver halide grains used therein is such a shape that the aspect ratio of each grain, namely the number obtained by dividing the projected area diameter of each grain by the thickness thereof, increases as the grain has a great projected area diameter. Such a light-sensitive layer is a unit light-sensitive layer having a color sensitivity to blue light, green light or red light. In a multilayer silver halide color photographic material, a red-sensitive layer, a green sensitive layer and a blue-sensitive layer as unit light-sensitive layers are generally arranged in that order from the support side. However, the foregoing order can be reversed depending on the purpose. And any two of the unit sensitive layers differing in color sensitivity may take another arrangement that a layer having one of the color sensitivities is sandwiched between layers having the other color sensitivity. The total thickness of light-sensitive layers is generally from 1 to 20 $\mu$m, preferably from 3 to 15 $\mu$m.

In the invention, an yellow filter layer, a magenta filter layer and an anti-halation layer are employed as colored layers containing oil-soluble dyes which can be decolorized by processing. In the case where red-sensitive, green-sensitive and blue-sensitive layers are arranged in that order from the support side, the yellow filter layer is arranged between the blue-sensitive layer and the green-sensitive layer, the magenta filter layer between the green-sensitive layer and the red-sensitive layer, and the anti-halation layer (cyan filter layer) between the red-sensitive layer and the support. These colored layers each may be in a direct contrast with an emulsion layer, or may be arranged so as to connect with an emulsion layer via an interlayer made up of gelatin or the like. The dyes are used in such amounts that the yellow, magenta and cyan filter layers have their own transmission densities in the range of 0.03 to 3.0, preferably 0.1 to 1.0, measured by the use of blue light, green light and red light respectively. More specifically, the amount of dyes used, through depends on their own $\epsilon$ and molecular weight, is from 0.005 to 2.0 mmol/m$^2$, preferably from 0.05 to 1.0 mmol/m$^2$.

Suitable examples of a usable dye include the cyclic ketomethylene compounds (such as 2-pyrazoline-5-one, 1,2,3,6-tetrahydropyridine-2,6-dione, rhodanine, hydantoin, thiohydantoin, 2,4-oxazolidinedione, isooxazolone, barbituric acid, thiobarbituric acid, indanedione, dioxopyrazolopyridine, hydroxypyridine, pyrazolidinedione, 2,5-dihydrofuran-2-one and pyrroline-2-one), the compounds having a structure made up of a methine group and two different kinds of groups selected from acidic nuclei derived from compounds having a methine group sandwiched between electron attracting groups (e.g., the methine group sandwiched between any two of —CN, —$SO_2R_1$, —$COR_1$, —$COOR_1$, —$CON(R_2)_2$, —$SO_2N(R_2)_2$, —C[=C(CN)$_2$]$R_1$, —C[=C(CN$_2$)$_2$]N($R_1$)$_2$, wherein $R_1$ is an alkyl, alkenyl, aryl, cycloalkyl or heterocyclic group and $R_2$ is a hydrogen atom or a group as recited above for $R_1$), basic nuclei (e.g., pyridine, quinoline, indolenine, oxazole, imidazole, thiazole, benzoxazole, benzimidazole, benzothiazole, oxazoline, naphthoxazole, pyrrole), aryl groups (e.g., phenyl, naphthyl) and heterocyclic groups (e.g., pyrrole, inhole, furan, thiophene, imidazole, pyrazole, indolizine, quinoline, carbazole, phenothiazine, phenoxazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin, chroman), and (NC)$_2$C=C(CN)—$R_3$ (wherein $R_3$ is an aryl or heterocyclic group).

The present photographic material may contain a mixture of two or more dyes in one colored layer. For instance, the mixture of three kinds of dyes, namely yellow, magenta and cyan dyes, may be used for the anti-halation layer.

In using decolorizable dyes, it is desirable that the dyes be dissolved in oil and/or water-soluble polymer and dispersed in the form of oildrops into a hydrophilic binder. For preparation of such a dispersion, it is desirable to adopt an emulsified dispersion method. Therein, the high boiling oils are disclosed in U.S. Pat. Nos. 4,555,470, 4,536,466, 4,587,206, 4,555,476 and 4,599,296, and JP-B-3-62256 (the term "JP-B" as used herein means an "examined Japanese patent publication") can be used, if desired, in combination with low boiling organic solvents having their boiling points in the range of 50 to 60° C. Additionally, those high boiling oils may be used alone or as a mixture of two or more thereof, and they may be replaced by oil-soluble polymers or used in combination with such polymers. Examples of such cases are disclosed in PCT international publication No. WO88/00723. The appropriate amount of high boiling oils and/or oil-soluble polymers used is from 0.01 to 10 g, preferably from 0.1 to 5 g, per g of dyes.

Further, it is possible to dissolve dyes in polymers using a latex dispersion method. The steps constituting such a method and examples of a latex used for impregnation are disclosed in U.S. Pat. No. 4,199,363, West German Patent Application (OLS) Nos. 2,541,274 and 2,541,230, and JP-B-53-41091 and EP-A-029104.

When the oil drops are dispersed into a hydrophilic binder, various surfactants can be used. For instance, the surfactants disclosed in JP-A-59-157636, pp. 37–38, and *Kochi Gijutu* (for which the English is "Known Technology"), No. 5, pp. 136–138 (published on Mar. 22, 1991, by Azutec Ltd.). In addition, the phosphoric acid ester type surfactants disclosed in JP-A-7-56267, JP-A-7-228589 and West German Patent 932,299 A can also be used.

It is desirable for the hydrophilic binder to be a water-soluble polymer. Suitable examples of such a water-soluble polymer include natural compounds, such as protein (e.g., gelatin, gelatin derivatives) and polysaccharide (e.g., cellulose derivatives, starch, gum arabic, dextran, pullulan), and synthetic high molecular compound, such as polyvinyl alcohol, polyvinyl pyrrolidone and acrylamine polymers. These water-soluble polymers can be used as a combination of two or more thereof. In such a combined use, the combination of gelatin with another water-soluble polymer is preferred over the others. The gelatin used therein may be selected from various processed gelatins, including lime-processed gelatin, acid-processed gelatin and the so-called delimed gelatin, or the gelatin reduced in calcium content and so on, depending on the desired purpose. Such processed gelatins can also be used as a combination of two or more thereof.

The dyes are decolorized in the presence of a decolorizing agent at the time of processing.

Examples of a decolorizing agent include alcohols or phenols, amines or anilines, sulfinic acids or salts thereof, sulfurous acid or salts thereof, thiosulfuric acid or salts thereof, carboxylic acids or salts thereof, hydrazines, guanidines, aminoguanidines, amidines, thiols, cyclic or linear active methylene compounds, cyclic or linear active methine compounds, and anions generated from the compounds recited above.

Of these decolorizing agents, hydroxyamines, sulfinic acids, sulfurous acid, guanidines, aminoguanidines, heterocyclic thiols, cyclic or linear active methylene compounds and cyclic or linear active methine compounds are preferred over the others. In particular, guanidines and aminoguanidines are used to advantage.

When the decolorizing agents as recited above are brought into contact with dyes upon processing, they are supposed to cause nucleophilic addition to dye molecules, thereby decolorizing the dyes. In a preferred case, subsequently to or simultaneously with imagewise exposures, the silver halide photographic material in which dyes are contained is brought into a face-to-face contact with a processing element containing a decolorizing agent or a precursor thereof in the presence of water, undergoes heating, and then separated from the processing element; as a result, the developed color images are formed in the photographic material and the dyes are decolorized. In such a case, it is desirable that the density of dyes after decolorization be reduced to at most ⅓, preferably at most ⅕, its initial value. The amount of decolorizing agents used is from 0.1 to 200 times by mole, preferably from 0.5 to 100 times by mole, the amount of dyes used.

The silver halide grains, color developing agents and couplers may be incorporated in the same light-sensitive layer or separate layers. In addition to the light-sensitive layers, the present photographic material may have light-insensitive layers, such as a protective layer, a subbing layer, interlayers and the yellow filter and anti-halation layers as mentioned above. Further, a backing layer may be provided on the back of the present photographic material. The appropriate total thickness of the coated layers on the light-sensitive layer side is from 3 to 25 $\mu$m, preferably from 5 to 20 $\mu$m.

To the photographic material, various additives, including a hardener, a surfactant, a photographic stabilizer, an antistatic agent, a slipping agent, a matting agent, latex, a formaldehyde scavenger, dyes and a UV absorbent, can be added for a variety of purposes. Examples of such additives are disclosed in the Research Disclosure as cited above and Japanese Patent Application No. 8-30103. Additionally, the fine grains of metal oxides, such as ZnO, $TiO_2$, $SnO_2$, $Al_2O_3$, $In_2O_3$,$SiO_2$, MgO, BaO, $MoO_3$ and $V_2O_5$, are particularly preferred as antistatic agents.

As a support of the photographic material, the photographic supports described in a book compiled by Japanese Photographic Society, entitled "Shashin Kogaku no Kiso-Gin-en Shashin-hen" (which means "Fundamentals of Photographic Engineering—Volume on Silver Halide Photography"), pp. 223–240, published by Corona-sha in 1979, are preferred. Specifically, polyethylene terephthalate, polyethylene naphthlate, polyvarbonate, syndiotactic polystyrene and celluloses (e.g., triacetyl cellulose) can be preferably employed.

For the purpose of improving optical characteristics and physical characteristics, those supports can be subjected to heat treatment (for control of crystallinity and orientation), uniaxial and biaxial drawing (for orientation control), blending with various polymers, and surface treatment.

Further, it is desirable that the support used have a magnetic recording layer as disclosed in JP-A-4-124645, JP-A-6-35092 or JP-A-6-31875 and the photography information be recorded thereon.

Also, it is desirable that the waterproof polymer as disclosed in JP-A-8-292514 be coated on the back of a support used for the photographic material.

Details of polyester supports particularly suitable for the photographic material provided with the magnetic layer as mentioned above are described in *JIII Journal of Technical Disclosure,* 94–6023 (Japanese Patent Organization: Mar. 15, 1994). The appropriate support thickness is from 5 to 200 $\mu$, preferably from 40 to 120 $\mu$.

For development of the photographic material which has undergone imagewise exposure, a processing material, separate from the photographic material, can be used in the invention. The processing material contains at least a base and/or a base precursor. Examples of a base and a base precursor which are most suitable for the invention include the base generating systems as disclosed in European Patent 0,210,660 and U.S. Pat. No. 4,740,445, which utilize the combinations of basic metal compounds slightly soluble in water with the compounds capable of complexing the metal ions constituting the foregoing basic metal compounds in a water medium. When such a system is employed, it is desirable that the basic compound slightly soluble in water be added to the photographic material and the complexing compound be added to the processing material. Contrary to this, it is also possible to add the slightly soluble basic compound to the processing material and the complexing compound to the photographic material. As an example of a preferable combination, mention may be made of the system of using fine grains of zinc hydroxide in the photographic material and a picolinate, such as guanidine picolinate, in the processing material.

In the processing material, a mordant may be used. In this case, the use of a polymeric mordant is desirable. Further, the physical development nuclei as disclosed in Japanese Patent Application No. 7-322454, such as colloidal silver and palladium sulfide, and a silver halide solvent like hydantoin may be incorporated in the processing material, and thereby the silver halide in the photographic material may be solubilized simultaneously with the development to be fixed in the processing material. In addition to those agents, the processing material may contain a development stopper and a print-out inhibitor.

Besides having a processing layer, the processing material may have other auxiliary layers, such as a protective layer, a subbing layer and a backing layer.

It is desirable for the processing material to have a form that the processing material having a processing layer provided continuously on a web is supplied from a sending-off roll, used for processing, and then wound around a separate roll without being cut out. Such a form is disclosed in JP-A-9-127670.

The processing material has no particular restriction as to the support used therein. For instance, the plastic films recited above for the photographic material and paper can be employed as the support. The appropriate thickness of such a support is from 4 to 120 $\mu$. In addition, the aluminum-deposited film as disclosed in Japanese Patent Application No. 8-52586 can also be used to advantage.

For developing the present photographic material having images taken by a camera, it is desirable to adopt a method in which the surface of the photographic material on the light-sensitive side is brought into a face-to-face contact with the processing layer of the processing material in the presence of water in an amount corresponding to from 1/10 to 10/10 of the amount required for causing the maximum swelling in the coated layers of the photographic material and the processing material, except in the backing layers thereof, and heated at a temperature of 50° to 100° C. for a period of 5 to 60 seconds.

The water can be applied using, e.g., a method of dipping the photographic material or the processing material in water and then removing more water than needed by means of a squeegee roller. In addition, it is also desirable to adopt the method disclosed in JP-A-10-26817, wherein the water is jetted with a water applying apparatus comprising a plurality of nozzles, whose holes for jetting water are arranged at regular intervals along the direction intersected with the travelling direction of the photographic material or the processing material, and an actuator for displacing the nozzles to the photographic material or the processing material on the path for travel. Further, the method of applying water with a sponge is desirable, too.

The heating in the developing process may be effected by the contact with a heated block or plate, or by the use of a hot roller, hot drum, infrared lamp or far infrared lamp.

In the invention, it is not essential for the photographic material to particularly undergo bleach-fix processing for removing the remaining silver halide and developed silver after development. However, the fixation process and/or the bleach process may be introduced in order to reduce a load on the read of image information and improve the image storage characteristics. These processes may follow conventional liquid processing methods, but it is desirable to carry out them in accordance with the method as disclosed in JP-A-9-258402, wherein the photographic material is heated as it is brought into contact with processing agents coated on separate sheets. In this case, the suitable heating temperature is similar to that in the development process, namely from 50° C. to 100° C. In particular, it is preferable that the heating in those processes be carried out at the same heating temperature as chosen in the development process.

In the present invention, color images are formed in a recording material in accordance with the image information from images formed in the photographic material. More specifically, the image information is read photoelectrically by the intensity measurement of transmitted light, converted to digital signals, subjected to image processing and then outputted to a separate recording material. The material for output may be not only a silver halide photographic material but also a sublimation type heat-sensitive recording material, a full-color direct heat-sensitive recording material, an ink jet material or an electrophotographic material.

Now, the present invention will be illustrated in more detail by reference to the following examples which are not to be considered as limiting on or determinative of the scope of the invention.

EXAMPLE 1

In a reaction vessel was placed 930 ml of distilled water containing 0.7 g of potassium bromide and 0.74 g of gelatin having an average molecular weight of 15,000, and heated to 40° C. To this solution with vigorous stirring, 30 ml of a water solution containing 0.34 g of silver nitrate and 30 ml of a water solution containing 0.24 g of potassium bromide were added over a 20-second period. After the addition was completed, this reaction solution was kept at 40° C. for one minute, and then heated up to 75° C. Thereto, 27.0 g of gelatin was further added together with 200 ml of distilled water, and then 100 ml of a water solution containing 23.36 g of silver nitrate and 80 ml of a water solution containing 16.37 g of potassium bromide were furthermore added at increasing flow rates over a 36-minute period. Subsequently thereto, 250 ml of a water solution containing 83.2 g of silver nitrate and a water solution containing potassium iodide and potassium bromide in a ratio of 3.97 by mole (potassium bromide concentration: 26%) were added over a 60-minute period while increasing the flow rates thereof, and that keeping the silver potential of the reaction solution at −20 mV to a saturated calomel electrode. Further, 75 ml of a water solution containing 18.7 g of silver nitrate and a 21.9% water solution of potassium bromide were added over a 10-minute period so that the silver potential of the reaction solution was kept at 20 mV to the saturated calomel electrode. After the addition was completed, the reaction solution was maintained at 75° C. for one minute, and then cooled to 40° C. The resulting reaction solution was adjusted to pH 9.0 by adding thereto 100 ml of a water solution containing 10.5 g of sodium p-iodoacetamidobenzenesulfonate monohydrate. Thereto was added 50 ml of a water solution containing 4.3 g of sodium sulfite, and then the resulting solution was kept at 40° C. for 3 minutes, followed by raising the solution temperature to 55° C. The resulting reaction solution was adjusted to pH 5.8, and then admixed with 0.8 mg of sodium benzenethiosulfinate, 0.04 mg of potassium hexachloroiridate(IV) and 5.5 g of potassium bromide, followed by standing for 1 minute at 55° C. Thereto were further added 180 ml of a water solution containing 44.3 g of silver nitrate, 160 ml of a water solution containing 34.0 g of potassium bromide and 8.9 mg of potassium hexacyanoferrate (II) over a period of 30 minutes. After cooling, the reaction solution was desalted in a conventional manner. Then, gelatin was added so that the emulsion thus obtained had a gelatin concentration of 7 weight %. Further, the emulsion obtained was adjusted to pH 6.2.

The emulsion obtained comprised hexagonal tabular grains having an average grain size of 1.29 μm, expressed in terms of sphere equivalent diameter, an average grain thickness of 0.27 μm and an average aspect ration of 8.5 (wherein the term aspect ration refers to the projected area diameter/thickness ratio). This emulsion was referred to as Emulsion A-1.

In the same manner as Emulsion A-1 was prepared, the emulsions differing in grain shapes, specifically Emulsion A-2 comprising hexagonal tabular grains having an average grain size of 0.75 μm, expressed in terms of sphere equivalent diameter, an average grain thickness of 0.18 μm and an average aspect ration of 6.9, Emulsion A-3 comprising hexagonal tabular grains having an average grain size of 0.52 μm, expressed in terms of sphere equivalent diameter, an average grain thickness of 0.18 μm and an average aspect ration of 4.0, and Emulsion A-4 comprising tabular grains having an average grain size of 0.44 μm, expressed in terms of sphere equivalent diameter, an average grain thickness of 0.18 μm and an average aspect ration of 3.1, were prepared. In the preparation of these Emulsions, however, the amounts of potassium hexachloroiridate (IV) added and those of potassium hexacyanoferrate (II) added were changed so as to be inversely proportional to their respective grain volumes, while the amounts of sodium p-iodoacetamidobenzenesulfonate monohydrate added were changed so as to be proportional to their respective grain circumferences.

Further, Emulsion A-5 was prepared as follows: In a reaction vessel was placed 930 ml of distilled water containing 0.37 g of gelatin having an average molecular weight of 15,000, 0.37 g of acid-processed gelatin and 0.7 g of potassium bromide, and heated the content to 40° C. To the resulting solution with vigorous stirring, 30 ml of a water solution containing 0.34 g of silver nitrate and 30 ml of a water solution containing 0.24 g of potassium bromide were added over a 20-second period. After the addition was completed, this reaction solution was kept at 40° C. for one minute, and then heated up to 75° C. Thereto, 27.0 g of gelatin having amino groups modified with trimellitic acid was further added together with 200 ml of distilled water, and then 100 ml of a water solution containing 23.36 g of silver nitrate and 80 ml of a water solution containing 16.37 g of potassium bromide were furthermore added at increasing flow rates over a 36-minute period. Subsequently thereto, 250 ml of a water solution containing 83.2 g of silver nitrate and a water solution containing potassium iodide and potassium bromide in a ration of 3:97 by mole (potassium bromide concentration: 26%) were added over a 60-minute period while increasing the flow rates thereof, and that keeping the silver potential of the reaction solution at −50 mV to a saturated calomel electrode. Further, 75 ml of a water solution containing 18.7 g of silver nitrate and a 21.9% water solution of potassium bromide were added over a 10-minute period so that the silver potential of the reaction solution was kept at 0 mV to the saturated calomel electrode. After the addition was completed, the reaction solution was maintained at 75° C. for one minute, and then cooled to 40° C. The resulting reaction solution was adjusted to pH 9.0 by adding thereto 100 ml of a water solution containing 10.5 g of sodium p-iodoacetamidobenzenesulfonatemonohydrate. Thereto was added 50 ml of a water solution containing 4.3 g of sodium sulfite, and then the resulting solution was kept at 40° C. for 3 minutes, followed by raising the solution temperature to 55° C. The resulting reaction solution was adjusted to pH 5.8, and then admixed with 0.8 mg of sodium benzenethiosulfinate, 0.04 mg of potassium hexachloroiridate(IV) and 5.5 g of potassium bromide, followed by standing for 1 minute at 55° C. Thereto were further added 180 ml of a water solution containing 44.3 g of silver nitrate, 160 ml of a water solution containing 34.0 g of potassium bromide and 8.9 mg of potassium hexacyanoferrate(II) over a period of 30 minutes. After cooling, the reaction solution as desalted in a conventional manner. Then, gelatin was added so that the emulsion thus obtained had a gelatin concentration of 7 weight %. Further, the emulsion obtained was adjusted to pH 6.2.

The emulsion obtained was an emulsion comprising hexagonal tabular grains having an average grain size of 1.29 μm, expressed in terms of sphere equivalent diameter, an average grain thickness of 0.13 μm and an average aspect ratio of 25.4.

In the same manner as Emulsion A-5 was prepared, the emulsions differing in grain shapes, specifically Emulsion A-6 comprising hexagonal tabular grains having an average grain size of 0.75 μm, expressed in terms of sphere equivalent diameter, an average grain thickness of 0.11 μm and an average aspect ratio of 14.0, Emulsion A-7 comprising hexagonal tabular grains having an average grain size of 0.52 μm, expressed in terms of sphere equivalent diameter, an average grain thickness of 0.09 μm and an average aspect ratio of 11.3, and Emulsion A-8 comprising tabular grains having an average grain size of 0.44 μm, expressed in terms of sphere equivalent diameter, an average grain thickness of 0.07 μm and an average aspect ratio of 10.5, were prepared. In the preparation of these Emulsions, however, the amounts of potassium hexachloriridate(IV) added and those of potassium hexacyanoferrate(II) added were changed so as to be inversely proportional to their respective grain volumes, while the amounts of sodium p-iodoacetamidobenzenesulfonate monohydrate added were changed so as to be proportional to their respective grain circumferences.

To Emulsion A-1, 5.6 ml of a 1% water solution of potassium iodide was added at 40° C. The resulting emulsion was spectrally and chemically sensitized by the addition of a $6.1\times10^{-4}$ mole of a spectral sensitizing dye as illustrated below, Compound I as illustrated below, potassium thiocyanate, chloroauric acid, sodium thiosulfite and mono (pentafluorophenyl)diphenylphosphine selenide. After the completion of chemical sensitization, Stabilizer S illustrated below was added in an amount of $1.2\times10^{-4}$ mole. Therein, the amounts of chemical sensitizers used were each adjusted so as to chemically sensitize the emulsion to the optimum extent.

Sensitizing Dye for Blue-sensitive Emulsion

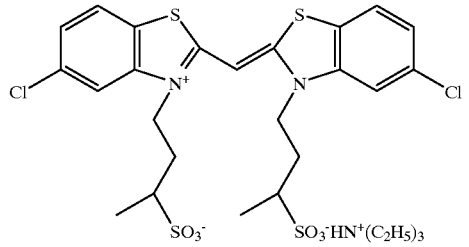

Compound I (Stabilizer)

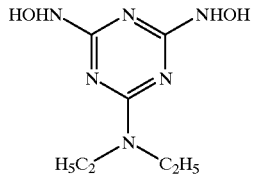

Stabilizer S

5:2 mixture of (a) and (b)

((a): $2\times10^{-4}$ mol/mol-Ag with respect to Emulsion A-1

(b): $8\times10^{-5}$ mol/mol-Ag with respect to Emulsion A-1)

(a)

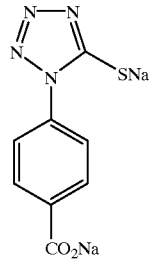

(b)

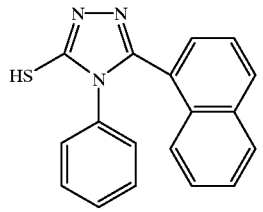

The thus prepared blue-sensitive emulsion was referred to as Emulsion A-1b.

In analogy with Emulsion A-1b, Emulsion A-2b, A-3b, A-4b, A-5b and A-6b were prepared by subjecting Emulsions A-2 to A-6 respectively to the same spectral sensitization and chemical sensitization as mentioned above. However, the amount of sensitizing dye added was changed depending on the surface area of silver halide grains in each emulsion. In addition, the amounts of chemicals used for chemical sensitization were adjusted so as to chemically sensitize each emulsion to the optimum extent.

Green-sensitive Embodiments A-1g, A-2g, A-3g, A-4g, A-5g, A-6g, A-7g and A-8g, and red-sensitive Emulsions A-1r, A-2r, A-3r, A-4r, A-5r, A-6r, A-7r and A-8r were prepared in the same manner as described above, except that the spectral sensitizing dye used was replaced by the dyes illustrated below.

Sensitizing Dye I for Green-sensitive Emulsions

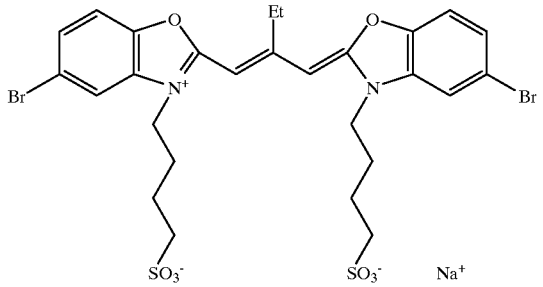

(amount added to Emulsion A-1: $5.5\times10^{-4}$ mole/mole Ag)

Sensitizing Dye II for Green-sensitive Emulsions

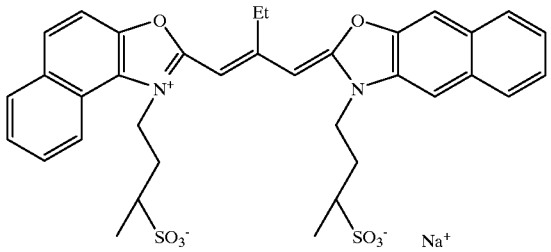

(amount added to Emulsion A-1: $1.3\times10^{-4}$ mole/mole Ag)

Sensitizing Dye III for Green-sensitive Emulsions

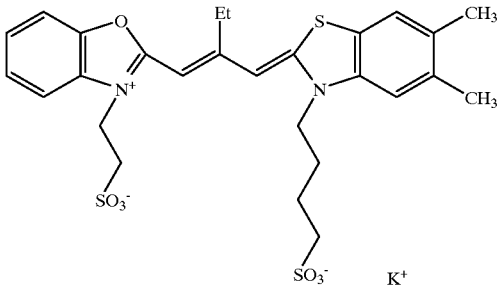

(amount added to Emulsion A-1: $4.8\times10^{-5}$ mole/mole Ag)

Sensitizing Dye I for Red-sensitive Emulsions

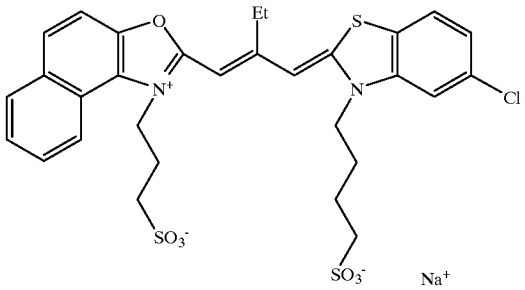

(amount added to Emulsion A-1: $2.5\times10^{-4}$ mole)

Sensitizing Dye II for Red-sensitive Emulsions

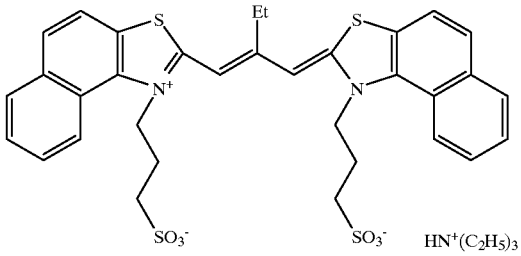

(amount added to Emulsion A-1: $6.3\times10^{-5}$ mole)

Sensitizing Dye II for Red-sensitive Emulsions

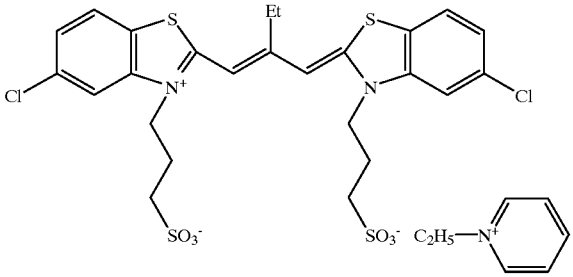

(amount added to Emulsion A-1: $3.1\times10^{-4}$ mole)

In the next place, a dispersion of zinc hydroxide used as base precursor was prepared.

A zinc hydroxide powder, the primary grains of which had a size of 0.2 $\mu$m, in an amount of 31 g was mixed with 1.6 g of carboxymethyl cellulose as a dispersant, 0.4 g of sodium olyacrylate, 8.5 g of lime-processed ossein gelatin and 158.5 ml of water, and dispersed for 1 hour with a mill using glass beads. After the dispersion was completed, the glass beads were filtered out. Thus, 188 g of the zinc hydroxide dispersion was obtained.

Further, emulsified dispersions containing couplers and incorporated developing agents were prepared as follows:

A mixture of 8.95 g of yellow Coupler (a), 7.26 g of Developing Agent (b), 1.47 g of developing Agent (c), 0.17 g of Antifoggant (d), 0.28 g of Antifoggant (e), 18.29 g of high boiling organic Solvent (f) and 50.0 ml of ethyl acetate was made into a solution by heating at 60° C. This solution was mixed with 200 g of a water solution containing 18.0 g of lime-processed gelatin and 0.8 g of sodium dodecylbenzenesulfonate, and emulsified into dispersion over a 20-minute period by using a dissolver stirrer at 10,000 r.p.m. To the dispersion obtained, distilled water was added in an amount to make the total weight 300 g, and mixed for 10 minutes at 2,000 r.p.m.

Yellow Coupler (a)

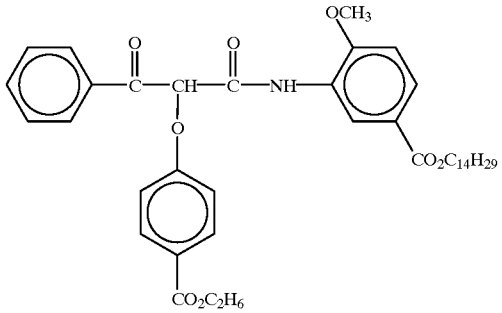

Incorporated Developing Agent (b)

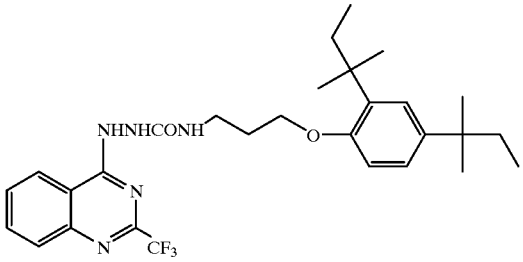

Incorporated Developing Agent (c)

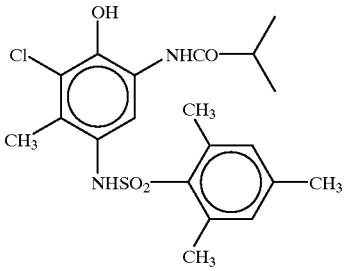

Antifoggant (d)

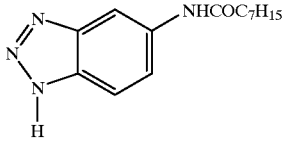

Antifoggant (e)

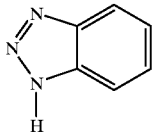

High Boiling Organic Solvent (f)

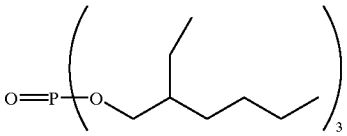

Then, a magenta coupler dispersion and a cyan coupler dispersion were prepared, too.

Specifically, a mixture of 7.65 g of magenta Coupler (g), 1.12 g of magenta Coupler (h), 8.13 g of Developing Agent (b), 1.05 g of Developing Agent (c), 0.11 g of Antifoggant (d), 7.52 g of high boiling organic Solvent (j) and 38.0 ml of ethyl acetate was made into a solution by heating at 60° C. This solution was mixed with 150 g of a water solution containing 12.2 g of lime-processed gelatin and 0.8 g of sodium dodecylbenzenesulfonate, and emulsified into dispersion over a 20-minute period b using a dissolver stirrer at 10,000 r.p.m. To the dispersion obtained, distilled water was added in an amount to make the total weight 300 g, and mixed for 10 minutes at 2,000 r.p.m.

A mixture of 10.78 g of cyan Coupler (k), 8.23 g of Developing Agent (b), 1.06 g of developing Agent (c), 0.15 g of Antifoggant (d), 8.27 g of high boiling organic Solvent (j) and 38.0 ml of ethyl acetate was made into a solution by heating at 60° C. This solution was mixed with 150 g of a water solution containing 12.2 g of lime-processed gelatin and 0.8 g of sodium dodecylbenzenesulfonate, and emulsified into dispersion over a 20-minute period by using a dissolver stirrer at 10,000 r.p.m. To the dispersion obtained, distilled water was added in an amount to make the total weight 300 g, and mixed for 10 minutes at 2,000 r.p.m.

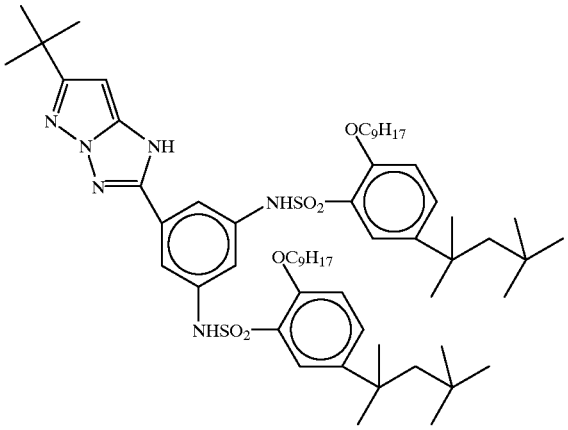

Magenta Coupler (g)

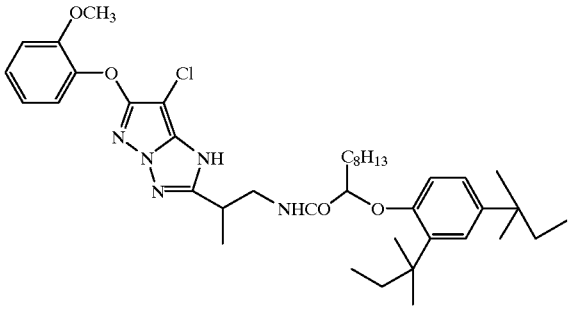

Magenta Coupler (h)

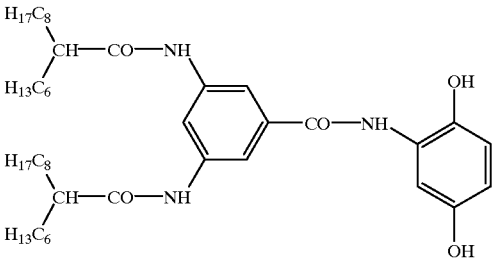

Compound (i)

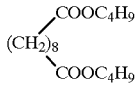

High Boiling Organic Solvent (j)

-continued

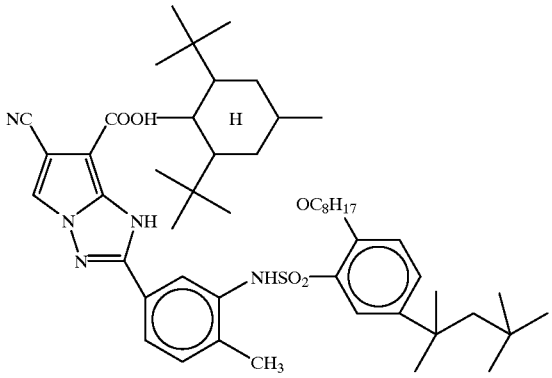

Cyan Coupler (k)

Furthermore, a dye dispersion for dyeing filter layers and an anti-halation layer as interlayers was prepared similarly to the above.

The dye used in each interlayer and the high boiling organic solvent used for dispersing the dye are illustrated below:

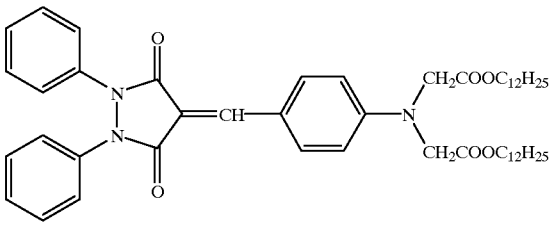

Yellow Dye (l)

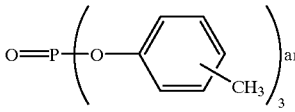

and Enpara K65 (produced by Ajinomoto Co., Inc. )

High Boiling Organic Solvent (m)
1:1 mixture of

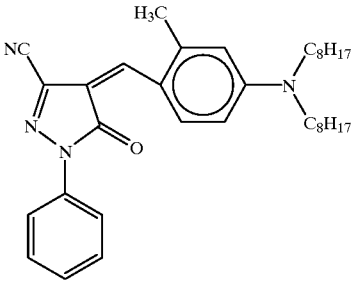

Magenta Dye (n)

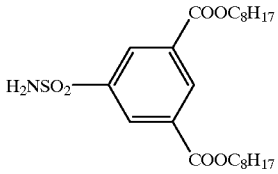

High Boiling Organic Solvent (o)

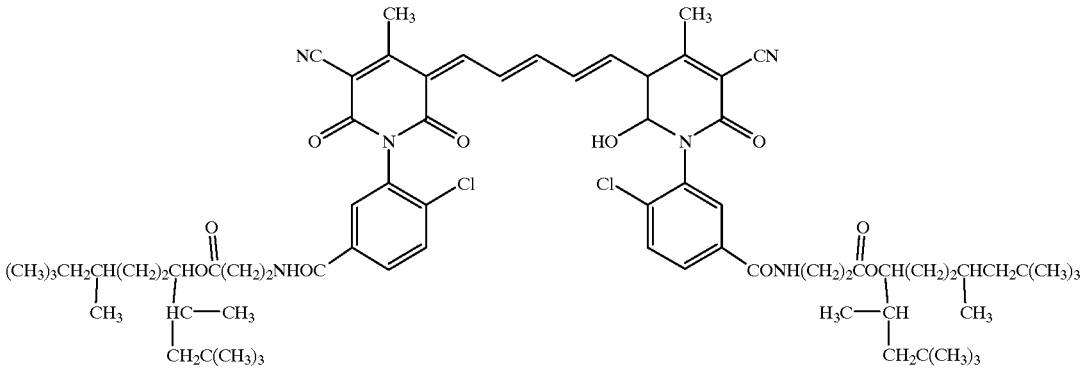

Cyan Dye (p)

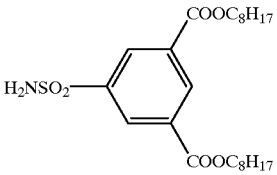

High Boiling Organic Solvent (g)

Those dispersions and the silver halide emulsions prepared above were combined so as to provide compositions set forth in Table 1, and coated on a support. Thus, multilayer color photographic materials, Sample Nos. 101 to 109, were prepared.

TABLE 1

Constitution of Multilayer Color Photographic Material

| | Sample 101 | Sample 102 | Sample 103 | Sample 104 | Sample 105 | Sample 106 | Sample 107 | Sample 108 | Sample 109 |
|---|---|---|---|---|---|---|---|---|---|
| Protective Layer | | | | | | | | | |
| Lime-processed gelatin | 914 | 914 | 914 | 914 | 914 | 914 | 914 | 914 | 914 |
| Matting agent (silica) | 50 | 50 | 50 | 50 | 50 | 50 | 50 | 50 | 50 |
| Surfactant (q) | 30 | 30 | 30 | 30 | 30 | 30 | 30 | 30 | 30 |
| $urfactant (r) | 40 | 40 | 40 | 40 | 40 | 40 | 40 | 40 | 40 |
| water-soluble polymer (s) | 15 | 15 | 15 | 15 | 15 | 15 | 15 | 15 | 15 |
| Hardener (t) | 110 | 110 | 110 | 110 | 110 | 110 | 110 | 110 | 110 |
| Interlayer | | | | | | | | | |
| Lime-processed gelatin | 461 | 461 | 461 | 461 | 461 | 461 | 461 | 461 | 461 |
| Surfactant (r) | 5 | 5 | 5 | 5 | 5 | 5 | 5 | 5 | 5 |
| Zinc hydroxide | 340 | 340 | 340 | 340 | 340 | 340 | 340 | 340 | 340 |
| Formaldehyde scavenger (u) | 300 | 300 | 300 | 300 | 300 | 300 | 300 | 300 | 300 |
| Water-soluble polymer (s) | 15 | 15 | 15 | 15 | 15 | 15 | 15 | 15 | 15 |
| Yellow color-forming layer (high speed layer) | | | | | | | | | |
| Lime-processed gelatin | 1750 | 1750 | 1750 | 1750 | 1750 | 1750 | 1750 | 1750 | 1750 |
| Emulsion-1 (based on silver coverage) | A-1b 220 | A-5b 220 | A-1b 220 | A-5b 220 | A-5b 220 | A-5b 220 | A-5b 220 | A-5b 220 | A-5b 220 |
| Emulsion-2 (based on silver coverage) | A-2b 330 | A-6b 330 | A-2b 330 | A-6b 330 | A-6b 330 | A-6b 330 | A-6b 330 | A-6b 330 | A-6b 330 |
| Yellow coupler (a) | 298 | 298 | 298 | 298 | 298 | 298 | 298 | 298 | 298 |
| Developing agent (b) | 242 | 242 | 242 | 242 | 242 | 242 | 242 | 242 | 242 |
| Developing agent (c) | 50 | 50 | 50 | 50 | 50 | 50 | 50 | 50 | 50 |
| Antifoggant (d) | 5.8 | 5.8 | 5.8 | 5.8 | 5.8 | 5.8 | 5.8 | 5.8 | 5.8 |
| Antifoggant (e) | 9.5 | 9.5 | 9.5 | 9.5 | 9.5 | 9.5 | 9.5 | 9.5 | 9.5 |
| PUG relessing compound | — | — | II-22 20.0 | II-22 20.0 | II-22 20.0 | II-22 20.0 | — | II-15 25.0 | II-2 16.0 |
| High boiling organic solvent (f) | 500 | 500 | 500 | 500 | 500 | 500 | 500 | 500 | 500 |
| Surfactant (y) | 27 | 27 | 27 | 27 | 27 | 27 | 27 | 27 | 27 |
| Water-soluble polymer (s) | 1 | 1 | 1 | 1 | 1 | 1 | 1 | 1 | 1 |
| Yellow color-forming layer (medium speed layer) | | | | | | | | | |
| Lime-processed gelatin | 1400 | 1400 | 1400 | 1400 | 1400 | 1400 | 1400 | 1400 | 1400 |
| Emulsion-1 (based on silver coverage) | A-2b 100 | A-6b 100 | A-2b 100 | A-6b 100 | A-6b 100 | A-6b 100 | A-6b 100 | A-6b 100 | A-6b 100 |
| Emulsion-2 (based on silver coverage) | A-3b 150 | A-7b 150 | A-3b 150 | A-7b 150 | A-7b 150 | A-7b 150 | A-7b 150 | A-7b 150 | A-7b 150 |
| Yellow coupler (a) | 277 | 277 | 277 | 277 | 277 | 277 | 277 | 277 | 277 |
| Developing agent (b) | 225 | 225 | 225 | 225 | 225 | 225 | 225 | 225 | 225 |
| Developing agent (c) | 46 | 46 | 46 | 46 | 46 | 46 | 46 | 46 | 46 |
| Antifoggant (d) | 5.3 | 5.3 | 5.3 | 5.3 | 5.3 | 5.3 | 5.3 | 5.3 | 5.3 |
| Antifoggant (e) | 8.8 | 8.8 | 8.8 | 8.8 | 8.8 | 8.8 | 8.8 | 8.8 | 8.8 |
| PUG releasing compound | — | — | II-19 18.0 | II-19 18.0 | II-19 18.0 | II-19 18.0 | — | II-20 16.0 | II-17 5.0 |
| High boiling organic solvent (f) | 566 | 566 | 566 | 566 | 566 | 566 | 566 | 566 | 566 |
| Surfactant (y) | 25 | 25 | 25 | 25 | 25 | 25 | 25 | 25 | 25 |
| Water-soluble polymer (s) | 2 | 2 | 2 | 2 | 2 | 2 | 2 | 2 | 2 |
| Yellow color-forming layer (low speed layer) | | | | | | | | | |
| Lime-processed gelatin | 1400 | 1400 | 1400 | 1400 | 1400 | 1400 | 1400 | 1400 | 1400 |
| Emulsion-1 (based on silver coverage) | A-3b 80 | A-7b 80 | A-3b 80 | A-7b 80 | A-7b 80 | A-7b 80 | A-7b 80 | A-7b 80 | A-7b 80 |
| Emulsion-2 (based on silver coverage) | A-4b 120 | A-8b 120 | A-8b 120 | A-8b 120 | A-8b 120 | A-8b 120 | A-8b 120 | A-8b 120 | A-8b 120 |
| Yellow coupler (a) | 277 | 277 | 277 | 277 | 277 | 277 | 277 | 277 | 277 |
| Developing agent (b) | 225 | 225 | 225 | 225 | 225 | 225 | 225 | 225 | 225 |
| Developing agent (c) | 46 | 46 | 46 | 46 | 46 | 46 | 46 | 46 | 46 |
| Antifoggant (d) | 5.3 | 5.3 | 5.3 | 5.3 | 5.3 | 5.3 | 5.3 | 5.3 | 5.3 |
| Antifoggant (e) | 8.8 | 8.8 | 8.8 | 8.8 | 8.8 | 8.8 | 8.8 | 8.8 | 8.8 |
| PUG releasing compound | — | — | II-19 26.0 | II-19 26.0 | II-19 26.0 | II-19 26.0 | — | II-20 20.0 | II-17 15.0 |
| High boiling organic solvent (f) | 566 | 566 | 566 | 566 | 566 | 566 | 566 | 566 | 566 |
| Surfactant (y) | 25 | 25 | 25 | 25 | 25 | 25 | 25 | 25 | 25 |
| Water-soluble polymer (s) | 2 | 2 | 2 | 2 | 2 | 2 | 2 | 2 | 2 |

TABLE 1-continued

| Constitution of Multilayer Color Photographic Material | Sample 101 | Sample 102 | Sample 103 | Sample 104 | Sample 105 | Sample 106 | Sample 107 | Sample 108 | Sample 109 |
|---|---|---|---|---|---|---|---|---|---|
| Interlayer (yellow filter layer) | | | | | | | | | |
| Lime-processed gelatin | 560 | 560 | 560 | 560 | 560 | 560 | 560 | 560 | 560 |
| Surfactant (y) | 15 | 15 | 15 | 15 | 15 | 15 | 15 | 15 | 15 |
| Surfactant (r) | 24 | 24 | 24 | 24 | 24 | 24 | 24 | 24 | 24 |
| Dye (1) | 85 | 85 | 85 | 85 | 85 | 85 | 85 | 85 | 85 |
| Compound (i) | — | — | — | — | — | 166 | — | — | — |
| Present Compound (SCC-32) | — | — | 225 | 225 | — | — | 225 | 225 | 225 |
| High boiling organic solvent (m) | 85 | 85 | 85 | 85 | 85 | 85 | 85 | 85 | 85 |
| Zinc Hydroxide | 125 | 125 | 125 | 125 | 125 | 125 | 125 | 125 | 125 |
| Water-soluble polymer (s) | 15 | 15 | 15 | 15 | 15 | 15 | 15 | 15 | 15 |
| Magenta color-forming layer (high speed layer) | | | | | | | | | |
| Lime-processed gelatin | 781 | 781 | 781 | 781 | 781 | 781 | 781 | 781 | 781 |
| Emulsion-1 (based on silver coverage) | A-1g 240 | A-5g 240 | A-1g 240 | A-5g 240 | A-5g 240 | A-5g 240 | A-5g 240 | A-1g 240 | A-5g 240 |
| Emulsion-2 (based on silver coverage) | A-2g 540 | A-6g 540 | A-2g 540 | A-6g 540 | A-6g 540 | A-6g 540 | A-6g 540 | A-2g 540 | A-6g 540 |
| Magenta coupler (g) | 80 | 80 | 80 | 80 | 80 | 80 | 80 | 80 | 80 |
| Magenta coupler (h) | 12 | 12 | 12 | 12 | 12 | 12 | 12 | 12 | 12 |
| Developing agent (b) | 85 | 85 | 85 | 85 | 85 | 85 | 85 | 85 | 85 |
| Developing agent (c) | 11 | 11 | 11 | 11 | 11 | 11 | 11 | 11 | 11 |
| Antifoggant (d) | 1.2 | 1.2 | 1.2 | 1.2 | 1.2 | 1.2 | 1.2 | 1.2 | 1.2 |
| PUG releasing compound | — | — | II-21 30.0 | II-21 30.8 | II-21 30.0 | II-21 30.0 | — | II-16 25.0 | II-22 20.0 |
| High boiling organic solvent (j) | 79 | 79 | 79 | 79 | 79 | 79 | 79 | 79 | 79 |
| Surfactant (y) | 8 | 8 | 8 | 8 | 8 | 8 | 8 | 8 | 8 |
| Water-soluble polymer (s) | 8 | 8 | 8 | 8 | 8 | 8 | 8 | 8 | 8 |
| Magenta color-forming layer (medium speed layer) | | | | | | | | | |
| Lime-processed gelatin | 659 | 659 | 659 | 659 | 659 | 659 | 659 | 659 | 659 |
| Emulsion-1 (based on silver coverage) | A-2g 250 | A-6g 250 | A-2g 250 | A-6g 250 | A-6g 250 | A-6g 250 | A-6g 250 | A-6g 250 | A-6g 250 |
| Emulsion-2 (based on silver coverage) | A-3g 400 | A-7g 400 | A-3g 400 | A-7g 400 | A-7g 400 | A-7g 400 | A-7g 400 | A-7g 400 | A-7g 400 |
| Magenta coupler (g) | 103 | 103 | 103 | 103 | 103 | 103 | 103 | 103 | 103 |
| Magenta coupler (h) | 15 | 15 | 15 | 15 | 15 | 15 | 15 | 15 | 15 |
| Developing agent (b) | 110 | 110 | 110 | 110 | 110 | 110 | 110 | 110 | 110 |
| Developing agent (c) | 14 | 14 | 14 | 14 | 14 | 14 | 14 | 14 | 14 |
| Antifoggant (d) | 1.5 | 1.5 | 1.5 | 1.5 | 1.5 | 1.5 | 1.5 | 1.5 | 1.5 |
| PUG releasing compound | — | — | II-21 24.0 | II-21 24.0 | II-21 24.0 | II-21 24.0 | — | II-16 22.0 | II-22 18.0<br>II-26 30.0 |
| High boiling organic solvent (j) | 102 | 102 | 102 | 102 | 102 | 102 | 102 | 102 | 102 |
| Surfactant (y) | 11 | 11 | 11 | 11 | 11 | 11 | 11 | 11 | 11 |
| Water-soluble polymer (s) | 14 | 14 | 14 | 14 | 14 | 14 | 14 | 14 | 14 |
| Magenta color-forming layer (low speed layer) | | | | | | | | | |
| Lime-processed gelatin | 711 | 711 | 711 | 711 | 711 | 711 | 711 | 711 | 711 |
| Emulsion-1 (based on silver coverage) | A-3g 100 | A-7g 100 | A-3g 100 | A-7g 100 | A-7g 100 | A-7g 100 | A-7g 100 | A-7g 100 | A-7g 100 |
| Emulsion-2 (based on silver coverage) | A-4g 140 | A-8g 140 | A-4g 140 | A-8g 140 | A-8g 140 | A-8g 140 | A-8g 140 | A-8g 140 | A-8g 140 |
| Magenta coupler (g) | 274 | 274 | 274 | 274 | 274 | 274 | 274 | 274 | 274 |
| Magenta coupler (h) | 40 | 40 | 40 | 40 | 40 | 40 | 40 | 40 | 40 |
| Developing agent (b) | 291 | 291 | 291 | 291 | 291 | 291 | 291 | 291 | 291 |
| Developing agent (c) | 38 | 38 | 38 | 38 | 38 | 38 | 38 | 38 | 38 |
| Antifoggant (d) | 3.9 | 3.9 | 3.9 | 3.9 | 3.9 | 3.9 | 3.9 | 3.9 | 3.9 |
| PUG releasing conpound | — | — | II-21 11.0 | II-21 11.0 | II-21 11.0 | II-21 11.0 | — | II-16 8.0 | II-22 6.0 |
| High boiling organic solvent (j) | 269 | 269 | 269 | 269 | 269 | 269 | 269 | 269 | 269 |
| Surfactant (y) | 29 | 29 | 29 | 29 | 29 | 29 | 29 | 29 | 29 |
| Water-soluble polymer (s) | 14 | 14 | 14 | 14 | 14 | 14 | 14 | 14 | 14 |
| Interlayer (magenta filter layer) | | | | | | | | | |
| Lime-processed gelatin | 850 | 850 | 850 | 850 | 850 | 850 | 850 | 850 | 850 |
| Surfactant (y) | 15 | 15 | 15 | 15 | 15 | 15 | 15 | 15 | 15 |
| Surfactant (r) | 24 | 24 | 24 | 24 | 24 | 24 | 24 | 24 | 24 |

TABLE 1-continued

| Constitution of Multilayer Color Photographic Material | Sample 101 | Sample 102 | Sample 103 | Sample 104 | Sample 105 | Sample 106 | Sample 107 | Sample 108 | Sample 109 |
|---|---|---|---|---|---|---|---|---|---|
| Dye (n) | 200 | 200 | 200 | 200 | 200 | 200 | 200 | 200 | 200 |
| Compound (i) | — | — | — | — | — | 106 | — | — | — |
| Present Compound (SCC-32) | — | — | 180 | 180 | — | — | 180 | 180 | 180 |
| High boiling organic solvent (o) | 200 | 200 | 200 | 200 | 200 | 200 | 200 | 200 | 200 |
| Formaldehyde scavenger (u) | 300 | 300 | 300 | 300 | 300 | 300 | 300 | 300 | 300 |
| Zinc hydroxide | 2028 | 2028 | 2028 | 2028 | 2028 | 2028 | 2028 | 2028 | 2028 |
| Water-soluble polymer (s) | 15 | 15 | 15 | 15 | 15 | 15 | 15 | 15 | 15 |
| Cyan color-forming layer (high speed layer) | | | | | | | | | |
| Lime-processed gelatin | 842 | 842 | 842 | 842 | 842 | 842 | 842 | 842 | 842 |
| Emulsion-1 (based on silver coverage) | A-1r 400 | A-5r 400 | A-1r 400 | A-5r 400 | A-5r 400 | A-5r 400 | A-5r 400 | A-5r 400 | A-5r 400 |
| Emulsion-2 (based on silver coverage) | A-2r 600 | A-6r 600 | A-2r 600 | A-6r 600 | A-6r 600 | A-6r 600 | A-6r 600 | A-6r 600 | A-6r 600 |
| Cyan coupler (k) | 64 | 64 | 64 | 64 | 64 | 64 | 64 | 64 | 64 |
| Developing agent (b) | 75 | 75 | 75 | 75 | 75 | 75 | 75 | 75 | 75 |
| Developing agent (c) | 6 | 6 | 6 | 6 | 6 | 6 | 6 | 6 | 6 |
| Antifoggant (d) | 0.9 | 0.9 | 0.9 | 0.9 | 0.9 | 0.9 | 0.9 | 0.9 | 0.9 |
| PUG releasing compound | — | — | II-19 10.0 | II-19 10.0 | II-19 10.0 | II-19 10.0 | — | II-20 22.0 | II-17 16.0 |
| High boiling organic solvent (j) | 49 | 49 | 49 | 49 | 49 | 49 | 49 | 49 | 49 |
| Surfactant (y) | 5 | 5 | 8 | 5 | 5 | 5 | 5 | 5 | 5 |
| Water-soluble polymer (s) | 18 | 18 | 18 | 18 | 18 | 18 | 18 | 18 | 18 |
| Cyan color-forming layer (medium speed layer) | | | | | | | | | |
| Lime-processed gelatin | 475 | 475 | 475 | 475 | 475 | 475 | 475 | 475 | 475 |
| Emulsion-1 (based on silver coverage) | A-2r 240 | A-6r 240 | A-2r 240 | A-6r 240 | A-6r 240 | A-6r 240 | A-6r 240 | A-6r 240 | A-6r 240 |
| Emulsion-2 (based on silver coverage) | A-3r 360 | A-7r 360 | A-3r 360 | A-7r 360 | A-7r 360 | A-7r 360 | A-7r 360 | A-7r 360 | A-7r 360 |
| Cyan coupler (k) | 134 | 134 | 134 | 134 | 134 | 134 | 134 | 134 | 134 |
| Developing agent (b) | 102 | 102 | 102 | 102 | 102 | 102 | 102 | 102 | 102 |
| Developing agent (c) | 13 | 13 | 13 | 13 | 13 | 13 | 13 | 13 | 13 |
| Antifoggant (d) | 1.9 | 1.9 | 1.9 | 1.9 | 1.9 | 1.9 | 1.9 | 1.9 | 1.9 |
| PUG releasing compound | — | — | II-19 15.0 | II-19 15.0 | II-19 15.0 | II-19 15.0 | — | II-20 18.0 | II-17 16.0<br>II-29 35.0 |
| High boiling organic solvent (j) | 103 | 103 | 103 | 103 | 103 | 103 | 103 | 103 | 103 |
| Surfactant (y) | 10 | 10 | 10 | 10 | 10 | 10 | 10 | 10 | 10 |
| Water-soluble polymer (s) | 15 | 15 | 15 | 15 | 15 | 15 | 15 | 15 | 15 |
| Cyan color-forming layer (low speed layer) | | | | | | | | | |
| Lime-processed gelatin | 825 | 825 | 825 | 825 | 825 | 825 | 825 | 825 | 825 |
| Emulsion-1 (based on silver coverage) | A-3r 180 | A-7r 180 | A-3r 180 | A-7r 180 | A-7r 180 | A-7r 180 | A-7r 160 | A-7r 180 | A-7r 180 |
| Emulsion-2 (based on silver coverage) | A-4r 270 | A-8r 270 | A-4r 270 | A-8r 270 | A-8r 270 | A-8r 270 | A-8r 270 | A-8r 270 | A-8r 270 |
| Cyan coupler (k) | 234 | 234 | 234 | 234 | 234 | 234 | 234 | 234 | 234 |
| Developing agent (b) | 179 | 179 | 179 | 179 | 179 | 179 | 179 | 179 | 179 |
| Developing agent (c) | 23 | 23 | 23 | 23 | 23 | 23 | 23 | 23 | 23 |
| Antifoggant (d) | 3.3 | 3.3 | 3.3 | 3.3 | 3.3 | 3.3 | 3.3 | 3.3 | 3.3 |
| PUG releasing compound | — | — | II-19 18.0 | II-19 18.0 | II-19 18.0 | II-19 18.0 | — | II-20 24.0 | II-17 14.0 |
| High boiling organic solvent (j) | 179 | 179 | 179 | 179 | 179 | 179 | 179 | 179 | 179 |
| Surfactant (y) | 17 | 17 | 17 | 17 | 17 | 17 | 17 | 17 | 17 |
| Water-soluble polymer (s) | 10 | 10 | 10 | 10 | 10 | 10 | 10 | 10 | 10 |
| Anti-halation layer | | | | | | | | | |
| Lime-processed gelatin | 440 | 440 | 440 | 440 | 440 | 440 | 440 | 440 | 440 |
| Surfactant (y) | 14 | 14 | 14 | 14 | 14 | 14 | 14 | 14 | 14 |
| Dye (p) | 200 | 200 | 200 | 200 | 200 | 200 | 200 | 200 | 200 |
| High boiling organic solvent (o) | 260 | 260 | 260 | 260 | 260 | 260 | 260 | 260 | 260 |
| Water-Soluble polymer (s) | 15 | 15 | 15 | 15 | 15 | 15 | 15 | 15 | 15 |
| Transparent PEN Base (96 μm) | | | | | | | | | |

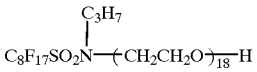

Surfactant (q)

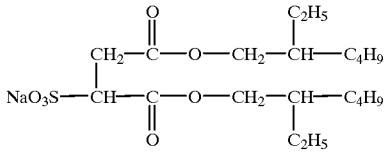

Surfactant (r)

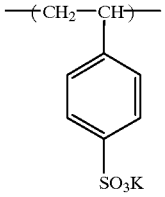

Water-soluble Polymer (s)

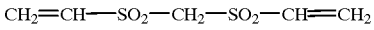

Hardener (t)

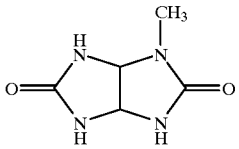

Formaldehyde Scavenger (u)

Furthermore, processing materials P-1 and P-2 as shown in Table 2 and 3 respectively were prepared.

TABLE 2

Constitution of Processing Material P-1

| Layer structure | Ingredients used | Amount added ($mg/m^2$) |
|---|---|---|
| Fourth layer (Protective layer) | Acid-processed gelatin | 200 |
| | Water-soluble polymer (v) | 60 |
| | Water-soluble polymer (w) | 200 |
| | Additive (x) | 80 |
| | Potassium nitrate | 16 |
| | Matting agent (z) | 10 |
| | Surfactant (r) | 7 |
| | Surfactant (aa) | 7 |
| | Surfactant (ab) | 10 |
| Third layer (Interlayer) | Lime-processed gelatin | 240 |
| | Water-soluble polymer (w) | 24 |
| | Hardener (ac) | 180 |
| | Surfactant (y) | 9 |
| Second layer (Base producing layer) | Lime-processed gelatin | 2100 |
| | Water-soluble polymer (w) | 360 |
| | Water-soluble polymer (ad) | 700 |
| | Water-soluble polymer (ae) | 600 |
| | High boiling organic solvent (af) | 2120 |
| | Additive (ag) | 20 |
| | Guanidine picolinate | 2613 |
| | Potassium quinolinate | 225 |
| | Sodium quinolinate | 192 |
| | Surfactant (y) | 24 |
| First layer (Subbing layer) | Lime-processed gelatin | 247 |
| | Water-soluble polymer (v) | 12 |
| | Surfactant (r) | 14 |
| | Hardener (ac) | 178 |
| | Transparent support (50 $\mu$m) | |

TABLE 3

Constitution of Processing Material P-2

| Layer structure | Ingredients used | Amount added ($mg/m^2$) |
|---|---|---|
| Fifth layer (Protective layer) | Acid-processed gelatin | 490 |
| | Matting agent (z) | 10 |
| Fourth layer (Interlayer) | Lime-processed gelatin | 240 |
| | Hardener (ac) | 250 |
| Third layer (Solvent layer) | Lime-processed gelatin | 4890 |
| | Silver halide solvent (ah) | 5770 |
| Second layer (Interlayer) | Lime-processed gelatin | 370 |
| | Hardener (ac) | 500 |
| First layer (Subbing layer) | Lime-processed gelatin | 247 |
| | Water-soluble polymer (v) | 12 |
| | Surfactant (r) | 14 |
| | Hardener (ac) | 178 |
| | Transparent support (50 $\mu$m) | |

Water-soluble polymer (v): κ-Carrageenan
Water-soluble Polymer (w): Sumikagel L-5H (trade name, a product of Sumitomo Chemical Co., Ltd.)

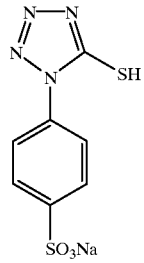

Additive (x)

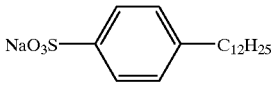

Surfactant (y)

Matting Agent (z)

SYLOID D79 (trade name, a product of Fuji Davison Co.)

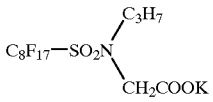

Surfactant (aa)

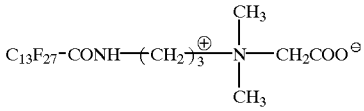

Surfactant (ab)

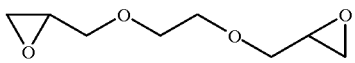

Hardener (ac)

Water-soluble Polymer (ad)

Dextrane (molecular weight: 70,000)

Water-soluble Polymer (as)

MP polymer MP102 (product of Kuraray Co., Ltd.)

High Boiling Solvent (af)

Enpara 40 (produced by Ajinomoto Co., Inc.)

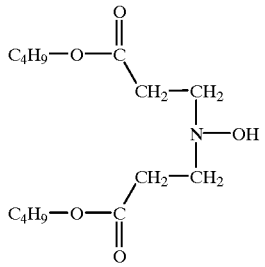

Additive (ag)

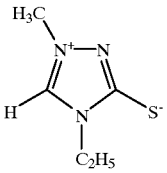

Silver Halide Solvent (ah)

A sample piece was cut out from each of the foregoing photographic material Samples 101 to 109, and exposed to 500-lux white light via an optical continuous wedge for 1/100 second in accordance with the method for determining ISO speed.

After exposure, 40° C. water was applied to each sample piece surface at a coverage of 15 ml/m$^2$. These water-applied sample pieces were each brought into face-to-face contact with the processing material P-1 and then underwent heat development at 83° C. for 15 seconds by means of a heat drum. Each of the sample pieces thus developed was separated from P-1, coated with 10 cc/m$^2$ of water on the surface side, and further brought into face-to-face contact with the processing material P-2, followed by 30-second heating at 50° C.

The thus developed sample pieces were examined for transmission densities of the colors developed therein, and thereby the fog density and ISO speed of each sample were determined.

Separate two sample pieces were prepared from each of Samples 101 to 109. Instead of the foregoing exposure to white light, one of the two sample pieces underwent exposure to red light (exposure via Fuji Filter SC62) and the other underwent exposure to green light (exposure via Fuji Filter BPN53). The thus exposed sample pieces were each subjected to the same heat development and subsequent transmission density measurement as described above. The H-D curves were plotted using the data obtained from the foregoing measurements, and therefrom the following values were read and taken as color stain indices.

Gr: The G density under the exposure amount providing the R density of Dmin+1.0 in the case of exposure to red light. This value was taken as an index of the color strain from the red-sensitive layer to the green-sensitive layer.

Bg: The B density under the exposure amount providing the G density of Dmin'1.0 in the case of exposure to green light. This value was taken as an index of the color strain from the green-sensitive layer to the blue-sensitive layer.

The thus determined fog, speed, Gr and Bg values are shown in Table 4.

TABLE 4

| Sample No. | note | Color stain inhibitor added in interlayer | PUG releasing compound | Emulsion grains | ISO speed | B fog | G fog | R fog | Gr | Bg |
|---|---|---|---|---|---|---|---|---|---|---|
| 101 | comparison | — | not added | A-1 to A-4 | 800 | 0.11 | 0.08 | 0.07 | 0.36 | 0.29 |
| 102 | comparison | — | not added | A-5 to A-8 | 1000 | 0.12 | 0.07 | 0.07 | 0.35 | 0.26 |
| 103 | invention | SCC-32 | added | A-1 to A-4 | 800 | 0.09 | 0.06 | 0.04 | 0.20 | 0.16 |
| 104 | invention | SCC-32 | added | A-5 to A-8 | 1000 | 0.10 | 0.06 | 0.05 | 0.19 | 0.14 |
| 105 | comparison | — | added | A-5 to A-8 | 1000 | 0.18 | 0.14 | 0.12 | 0.30 | 0.22 |
| 106 | comparison | Compound (i) | added | A-5 to A-8 | 640 | 0.44 | 0.25 | 0.18 | 0.25 | 0.19 |
| 107 | comparison | SCC-2 | not added | A-5 to A-8 | 800 | 0.09 | 0.07 | 0.05 | 0.29 | 0.22 |
| 108 | invention | SCC-32 | added | A-5 to A-8 | 1000 | 0.08 | 0.05 | 0.04 | 0.21 | 0.16 |
| 109 | invention | SCC-32 | added | A-5 to A-8 | 1000 | 0.12 | 0.08 | 0.06 | 0.15 | 0.11 |

Further, other samples (Samples 201 to 209) were prepared in the same manners as Samples 101 to 109 respectively, except that both incorporated developing agents (b) and (c) were removed therefrom.

These samples were exposed in the same manner as Samples 101 to 109, and developed in accordance with Standard Processing CN-16X for color negative films produced by Fuji Photo Film Co., Ltd.

The thus developed samples were examined for speed, fog, Gr and Bg values by the same methods as adopted for examination of Samples 101 to 109. The results obtained are shown in table 5.

TABLE 5

| Sample No. | Color stain inhibitor added in interlayer | PUG releasing compound | Emulsion grains | ISO speed | B fog | G fog | R fog | Gr | Bg |
|---|---|---|---|---|---|---|---|---|---|
| 201 | — | not added | A-1 to A-4 | 640 | 0.08 | 0.06 | 0.05 | 0.25 | 0.29 |
| 202 | — | not added | A-5 to A-8 | 800 | 0.09 | 0.06 | 0.06 | 0.26 | 0.31 |
| 203 | SCC-32 | added | A-1 to A-4 | 640 | 0.10 | 0.06 | 0.06 | 0.22 | 0.25 |
| 204 | SCC-32 | added | A-5 to A-8 | 800 | 0.11 | 0.07 | 0.08 | 0.22 | 0.26 |
| 205 | — | added | A-5 to A-8 | 800 | 0.11 | 0.07 | 0.08 | 0.24 | 0.26 |
| 206 | Compound (i) | added | A-5 to A-8 | 640 | 0.09 | 0.06 | 0.05 | 0.21 | 0.24 |
| 207 | SCC-2 | not added | A-5 to A-8 | 640 | 0.08 | 0.05 | 0.05 | 0.22 | 0.27 |
| 208 | SCC-32 | added | A-5 to A-8 | 800 | 0.11 | 0.07 | 0.06 | 0.23 | 0.26 |
| 209 | SCC-32 | added | A-5 to A-8 | 800 | 0.11 | 0.08 | 0.06 | 0.20 | 0.25 |

The data set froth above demonstrate that the invention had marked effects.

More specifically, the addition of a PUG releasing compound alone as in the case of Sample 105 brought about an increase in fog density and produced little effect on the inhibition of processing-induced color strain. The addition of Compound (i) often used for general color negative films to Sample 105 was effective for inhibition of processing-induced color strain, but gave rise to considerable increase in fog density and marked drop in speed. On the other hand, the addition of Compound SCC-32 to the interlayers as in the case of Sample 107 had some but insufficient effect on the inhibition of processing-induced color stain and, what was worse, lowered the speed.

By contrast, the photographic properties of Samples 103, 104, 108 and 109 according to the invention were fine in respect of speed, fog density and color stain. In particular, Sample 104 wherein the emulsion having high aspect ratios (from 10.5 to 25.4) were used was superior in photographic properties, especially speed, to Sample 103 differing from Sample 104 in only the aspect ratios (from 3.1 to 8.5) of the emulsions used therein. Therefore, it is clear that the combination according to the embodiment of Sample 104 is particularly useful.

On the other hand, Samples 201 to 209 wherein no developing agent was incorporated in the photographic materials, but the developing agent was applied thereto from the outside, had low photographic speeds, compared with Samples 101 to 109 respectively. Further, the combined use of a Component SC and a PUG releasing compound in Samples 201 to 209 had no synergistic effect on the inhibition of color strains.

ADVANTAGES OF THE INVENTION

In accordance with the invention, it is possible to provide a silver halide color photographic material for forming color images of high color saturation by simple and rapid processing, particularly by a heat-development processing, without attended by an increase in fog density and a decrease in photographic speed, and further to provide an image formation method using the aforementioned silver halide color photographic material.

What is claimed is:

1. A silver halide color photographic material comprising a support and a photographic element, the photographic element comprising silver halide grains, a developing agent and a coupler capable of forming a dye by reaction with an oxidation product of the developing agent, at least one compound represented by formula (SC-1) or (SC-2), and at least one compound represented by formula (II):

(SC-1)

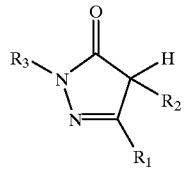

(SC-2)

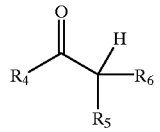

wherein $R_1$ represents a hydrogen atom or a substitution group; $R_2$ represents an alkyl group, an alkenyl group, an alkynyl group, an aryl group, a heterocyclic group, an alkoxycarbonyl group, an aryloxycarbonyl group or a carbamoyl group; $R_3$ represents a hydrogen atom, an alkyl group, an alkenyl group, an alkynyl group, an aryl group or a heterocyclic group; $R_4$ represents an alkyl group, an alkenyl group, an alkynyl group, an aryl group, a heterocyclic group, an alkoxy group, an aryloxy group, a heterocyclyloxy group, an amino group or an anilino group; $R_5$ represents an alkoxycarbonyl group, an aryloxycarbonyl group or a carbamoyl group; and $R_6$ represents an alkyl group, an alkenyl group, an alkynyl group, an aryl group or a heterocyclic group; and $R_4$ and $R_6$ may combine with each other to form a 5- to 7-membered ring, $$A—[(L_1)_a—(B)_m]_p—(L_2)_n—PUG \quad (II)$$

wherein A represents a coupler residue or a redox group and is a group splitting off the moiety $[(L_1)_a—(B)_m]_p—(L_2)_n—$PUG by reacting with an oxidation product of the developing agent; $L_1$ is a timing and linkage group whose bond with $—(B)_m$ is cleaved after a cleavage of the bond with A—; B represents a group which turns into a redox group or a coupler residue and causes the cleavage with $—(L_2)_n$ by the reaction with the oxidation product of the developing agent; $L_2$ represents a timing and linkage group whose bond with —PUG is cleaved after cleavage of the bond with $—(B)_m$; PUG represents a photographically useful group; a, m and n are each 0 or 1; an p is an integer of 0 to 2, wherein two $[(L_1)_a—(B)_m]$ moieties in the case of p=2 are the same or different.

2. A silver halide color photographic material according to claim 1, wherein the PUG in formula (II) is a development inhibitor.

3. A silver halide color photographic material according to claim 1, which comprises at least three silver halide light-sensitive layers having different spectral sensitivities and at least one light-insensitive layer between the light-sensitive layers, wherein the at least one light-insensitive layer contains the at least one compound represented by formula (SC-1) or (SC-2).

4. A silver halide color photographic material according to claim 1, wherein the photographic element comprises a silver halide emulsion layer, in which at least 50% of the total silver halide grains are tabular grains having an aspect ratio of from 8 to 50.

5. A silver halide color photographic material according to claim 1, wherein $R_1$ is a substituent group which is selected from the group consisting of a hydrogen atom, a halogen atom, an alkyl group, an alkenyl group, an alkynyl group, an aryl group, a heterocyclic group, a silyl group, a hydroxyl group, an alkoxy group, an aryloxy group, a heterocyclyloxy group, a silyoxy group, an acyloxy group, an alkoxycarbonyloxy group, an aryloxycarbonyloxy group, a carbamoyloxy group, a sulfamoyloxy group, an alkanesulfonyloxy group, an arenesulfonyloxy group, a cyano group, an acyl group, an alkoxycarbonyl group, an aryloxycarbonyl group, a carbamoyl group group, an amino group, an anilino group, a heterocyclylamino group, a carbonamido group, an ureido group, an imido group, an alkoxycarbonylamino group, an aryloxycarbonylamino group, a sulfonamido group, a sulfamoylamino group, an azo group, a nitro group, an alkylthio group, an arylthio group, a heterocyclylthio group, an alkanesulfinyl group, an arenesulfinyl group, an alkanesulfonyl group, an arenesulfonyl group, a sulfamoyl group, a sulfo group, a phosphonyl group, and a phosphinoylamino group.

6. A silver halide color photographic material according to claim 1, wherein $R_1$ is selected from the group consisting of an alkyl group, an alkoxy group, an amino group, an anilino group, a carbonamido group, a sulfonamido group, an alkoxycarbonyl group and a cyano group.

7. A silver halide color photographic material according to claim 1, wherein $R_2$ is selected from the group consisting of an alkyl group, an alkoxycarbonyl group and a carbamoyl group.

8. A silver halide color photographic material according to claim 1, wherein $R_3$ is an alkyl group or an aryl group.

9. A silver halide color photographic material according to claim 1, wherein the coupler of formula (II) is present in an amount of $10^{-6}$ to $2\times10^{-3}$ mole per $m^2$ of silver halide color photographic material.

10. A method of forming a color image, comprising the steps of:

preparing a silver halide color photographic material according to claim 1 and a processing element comprising a support and a processing layer containing at least one of a base and a base precursor;

subjecting the color photographic material to imagewise exposure;

applying water to at least one of the photographic material and the processing element in an amount corresponding to from 1/10 to 10/10 of the amount required for causing the maximum swelling in both of the photographic material and the processing element, except in backing layers of the photographic material and the processing element;

superimposing the photographic material on the processing element so that a light-sensitive layer of the photographic material and the processing layer are faced to each other; and heat the superimposed photographic material and processing element at a temperature of 50 to 100° C. for 5 to 60 seconds to form a color image.

* * * * *

UNITED STATES PATENT AND TRADEMARK OFFICE

CERTIFICATE OF CORRECTION

PATENT NO. : 6,303,261 B1
DATED : October 16, 2001
INVENTOR(S) : Arakawa et al.

It is certified that error appears in the above-identified patent and that said Letters Patent is hereby corrected as shown below:

Title page,
Item [30], Foreign Application Priority Data, please correct the filing date to read:
-- March 15, 1999 --

Signed and Sealed this

Tenth Day of September, 2002

*Attest:*

*Attesting Officer*

JAMES E. ROGAN
*Director of the United States Patent and Trademark Office*